US011365894B2

(12) United States Patent
Qasem et al.

(10) Patent No.: US 11,365,894 B2
(45) Date of Patent: Jun. 21, 2022

(54) CLOSED-AIR CLOSED-DESICCANT HUMIDIFIER-DEHUMIDIFIER ATMOSPHERIC WATER GENERATOR SYSTEM

(71) Applicant: KING FAHD UNIVERSITY OF PETROLEUM AND MINERALS, Dhahran (SA)

(72) Inventors: Naef A. A. Qasem, Dhahran (SA); Mohamed A. Ahmed, Dhahran (SA); Syed M. Zubair, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 244 days.

(21) Appl. No.: 16/786,237

(22) Filed: Feb. 10, 2020

(65) Prior Publication Data

US 2021/0254844 A1 Aug. 19, 2021

(51) Int. Cl.
*F24F 3/14* (2006.01)

(52) U.S. Cl.
CPC .... *F24F 3/1417* (2013.01); *F24F 2003/1458* (2013.01)

(58) Field of Classification Search
CPC .. F24F 3/1417; F24F 2003/1458; C02F 1/265
See application file for complete search history.

(56) References Cited

U.S. PATENT DOCUMENTS

2002/0116935 A1 8/2002 Forkosh et al.
2008/0135495 A1 6/2008 Sher
2014/0014212 A1* 1/2014 Govindan ..... B01D 5/0045 137/806

FOREIGN PATENT DOCUMENTS

CN 101775824 A 7/2010
WO WO 2018/157628 A1 9/2018

OTHER PUBLICATIONS

Sharqawy et al, Optimum thermal design of humidification dehumidificationdesalination systems, 2014.*
M.A. Ahmed, et al., "An innovative closed-air closed-desiccant HDH system to extract water from the air: A case for zero-brine discharge system", Desalination, vol. 445, 2018, pp. 236-348.
(Continued)

*Primary Examiner* — Elizabeth J Martin
(74) *Attorney, Agent, or Firm* — Oblon, McClelland, Maier & Neustadt, L.L.P.

(57) ABSTRACT

An atmospheric water generator system which includes an air dryer system containing a plurality of air dryers configured to pass ambient air over a desiccant for the desiccant to absorb moisture from the air and a humidifier-dehumidifier system which is configured to humidify a gas mixture using the desiccant and dehumidify the humidified gas mixture to produce freshwater. The atmospheric water generator system includes a closed desiccant loop and a closed gas mixture loop configured such that ambient air does not enter the humidifier-dehumidifier system. The humidifier-dehumidifier system is configured such that the gas mixture passes back and forth between the humidifier and dehumidifier between two and six times in a single pass of the closed gas mixture loop. Also disclosed is a method of generating freshwater using the atmospheric water generator system.

10 Claims, 21 Drawing Sheets

(56) References Cited

OTHER PUBLICATIONS

Prakash Narayan Govindan, "Thermal Design of Humidification Dehumidification Systems for Affordable and Small-scale Desalination", Thesis, Massachusetts Institute of Technology, Deptartment of Mechanical Engineering, Sep. 2012, 286 pages.

* cited by examiner

CLOSED-AIR CLOSED-DESICCANT HUMIDIFIER-DEHUMIDIFIER ATMOSPHERIC WATER GENERATOR SYSTEM

STATEMENT OF PRIOR DISCLOSURE BY THE INVENTORS

Aspects of this technology are described in the article "The impact of thermodynamic balancing on performance of a desiccant-based humidification-dehumidification system to harvest freshwater from atmospheric air" published in Energy Conversion and Management, 2019, 199, available on Nov. 1, 2019, which is incorporated herein by reference in its entirety.

STATEMENT OF ACKNOWLEDGEMENT

This work was supported by the Research and Development Program, Research Pooling Initiative, Ministry of Education, Riyadh, Saudi Arabia.

BACKGROUND OF THE INVENTION

Technical Field

The present invention relates to a humidifier-dehumidifier atmospheric water generator system having a closed desiccant loop and a closed gas mixture loop and a method of generating freshwater using the atmospheric water generator system.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Freshwater scarcity is one of the major issues that is facing humanity in many countries. With growing population, as well as agricultural and industrial use, freshwater needs are anticipated to significantly increase in coming decades[U. Nations, World Population Prospects The 2012 Revision, New York, 2013]. Water demand is expected to exceed the available water resources by 40% in 2030 [F R Rijsberman, Agric. Water Manag., 2006; 80:5-22]. Thus, water purification methods are critically important wherever the natural resources of drinking water are scarce [A K Venkatesan, et. al., Desalination, 2011; 272:120-127]. Desalination of saltwater is one technological solution to water purification used currently. The seawater and brackish water are the primary resources used in these technologies to obtain a satisfactory amount of freshwater [NAA Qasem, et. al., Desalination, 2018; 441]. Other resources such as water content in the humid air (especially, in coastal areas) could efficiently be used as a water resource to obtain sufficient amounts of freshwater [MA Ahmed, et. al., Desalination, 2018; 445:236-248]. Desiccant-based systems have been used for air conditioning purposes.

Recently, desiccant-based desalination systems have been proposed [MA Ahmed, et. al., Energy Conyers Manag, 2017; 148:161-173]. Such systems have been tested to be an energy-efficient technology to produce freshwater [R Qi, et. al., Energy Conyers Manag, 2015; 106:1387-1395]. These systems described by the authors of these proposals and tests as eco-friendly [M Mujahid Rafique, et. al., Renew Sustain Energy Rev, 2015; 45:145-159]. Modi and Shukla [K V Modi, D L Shukla, Energy Conyers Manag, 2018; 171:1598-1616] investigated a desiccant regeneration process for a hybrid solar-powered air conditioning/desalination system. A hybridization between desiccant dehumidification and absorption cooling system was investigated [B Su, et. al., Energy Conyers Manag, 2017; 153:515-525] for achieving both cooling and water production. Kabeel et al. [A E Kabeel, et. al., Energy Conyers Manag, 2017; 150:382-391] explored a hybridization of a desiccant cooling system with a humidification-dehumidification desalination (HDH) system to obtain freshwater along with a cooling effect. A new hybrid liquid desiccant cooling/desalination system has been suggested by modifying the traditional desiccant system by adding a condenser (additional component) between the system humidifier and regenerator. The system was able to produce about 86 $kgh^{-1}$ pure water as a by-product for a condenser effectiveness of 0.8. The cooling effect was the main product with a COP of 0.9.

A desiccant system to produce water from atmospheric air using solar energy was tested to produce 2.32 $Lm^{-2}$ per day [GE William, et. al., Energy, 2015; 90:1707-1720]. The most recent liquid desiccant-based system to produce freshwater from ambient humid air is a liquid desiccant-based HDH. The water production of this system was about 8 $kgh^{-1}$. It (desiccant HDH) was proposed by adding one air dryer to the normal HDH system. The diluted (weak) desiccant is sprayed into the humidifier, in which it exchanges some water content with the circulated air. The humidified air from the humidifier losses this gained water content in the dehumidifier as freshwater, which is collected [MA Ahmed, et. al., Desalination 2018; 445:236-248].

The aforementioned studies focused on introducing some novel or hybrid desiccant-based systems. Moreover, because of mass and heat exchange between the desiccant and circulated air, thermodynamic balancing approach is viable to improve the performance of such systems by minimizing the entropy generation [GP Thiel, et. al., Appl Energy, 2014; 118:292-299]. In particular, thermodynamic balancing was successfully investigated and reported for substantial enhancement in the performance of HDH systems by applying mass extractions from the humidifier to be injected into the dehumidifier [K M Chehayeb, et. al., Int J Heat Mass Transf, 2014; 68:422-434]. Extraction of water or air from the humidifier into the dehumidifier and vice versa was also investigated [GP Narayan, et. al., Int J Therm Sci, 2010; 49:2057-2066]. Another way to achieve thermodynamic balancing is by continuously changing a water-to-air mass ratio to decrease the water and air temperature difference at the humidifier and dehumidifier terminals [H. Müller-Holst, Sol. Desalin. 21st Century, 2007, 215-225]. An HDH system having three stages was proposed [T. Schlickum, Device for separating a liquid from its dissolved matters, European Patent, EP 1770068 A2, 2007.] to have three water streams coupled in series with a separated air stream to be recirculated for each stage. Also, a four-stage cross flow HDH solar desalination system was investigated [Y Zhao, et. al., Desalination, 2019; 467:147-157]. Driven by forced convection, an HDH system was thermodynamically balanced by extraction of some streams between the dehumidifier and humidifier [T Brendel, Ruhr University Bochum; 2003.]. Two-stream extractions from the humidifier to be injected into the dehumidifier were also investigated [MA Younis, et. al., Desalination, 1993; 94:11-24].

McGovern et al. [RK McGovern, et. al., Appl Energy, 2013; 102:1081-1090] found a 300% enhancement in the seawater HDH performance by just applying a single extraction between the humidifier and dehumidifier. They also showed that the ratio of water production to the inlet saline water increased from 7% to 11%. About 54% increase in the HDH performance was experimentally reported for a single air extraction [GP Narayan, et. al., Int J Heat Mass Transf, 2013; 58:740-748].

The idea of thermodynamic balancing is to reduce entropy production, resulting in a tremendous improvement in the HDH performance [KH Mistry, et. al., Int J Therm Sci, 2010; 49:1837-1847]. A multi-stage HDH system was considered as a thermodynamically balanced system [M Zamen, et. al., Chem Eng Trans, 2011; 25:1091-1096]. In this system, a new performance index denoted by "temperature pinch" was suggested as the difference between the water and air temperatures at each stage terminals. For a one-stage system (containing one humidifier and one dehumidifier), the "temperature pinch" method is applied to minimize the temperature difference of the air and saline water at the inlet and outlet of the humidifier and dehumidifier. For a multi-stage system, the approach aims at minimizing the temperature difference at the inlet and outlet of each stage. Thus, for an infinite number of stages, the temperature difference of air and saline water reaches zero along with the whole humidifying and dehumidifying processes. The "temperature pinch" method focuses on heat exchange between the air and saline water (or other solutions). However, the real process includes heat and mass exchanges. Thus, it was suggested that the temperature pinch is not sufficient to approach the fully thermodynamic balanced system.

For this reason, another index was proposed, that is "enthalpy pinch", to efficiently replace the "temperature pinch" [GP Narayan, et. al., Int J Heat Mass Transf, 2013; 57:756-770] by considering both the heat and mass exchanges [GP Thiel, et. al., Int J Heat Mass Transf, 2012; 55:5133-5147]. The enthalpy pinch was used to design conventional and modified closed-air open-water HDH systems [SM Elmutasim, et. al., Desalination, 2018; 435:114-127]. The implementation of enthalpy pinch was assessed as a robust method for HDH design and optimization [KM Chehayeb, et. al., Desalination, 2015; 369:125-139]. It was implemented for zero and multiple extractions. At zero enthalpy pinch, the system is approaching the reversibility limit. Similar to seawater desalination, thermodynamic balancing was carried out for desiccant-based HDH systems.

The enthalpy versus temperature plot is usually used to study the thermodynamic balancing principle. This graphical method was so called "the pinch technology" [S Hou, et. al., Desalination, 2005; 183:143-149; and S Hou, Desalination, 2008; 222:572-578]. The evaluation of temperature—enthalpy profiles in HDH systems having some extractions was explored [JA Miller, et. al., Desalination, 2013; 313:87-96]. One-stage [X Huang, et. al., Desalination, 2019; 455:19-33], two-stage [X Huang, et. al., Energy Conyers Manag, 2019; 197:111872] and up to six-stage [H Kang, et. al., Desalination, 2016; 385:158-166] HDH systems have recently modeled using this graphical method. It is also implemented for HDH coupled with heat pump [WF He, et. al., Energy Conyers Manag, 2019; 194:11-21]. The first experimental verification of the graphical method and enthalpy pinch was carried out by Narayan et al. [GP Narayan, et. al., Int J Heat Mass Transf, 2013; 58:740-748].

It is important to note that the aforementioned enthalpy pinch literature has mainly focused on the water-based HDH systems to evaluate the system performance using the thermodynamic balancing concept. The desiccant-based HDH was, however, has not been investigated using this concept.

In view of the foregoing, one objective of the present invention is to provide a desiccant-based HDH system with a closed desiccant loop and a closed air loop. Said HDH system comprises a plurality of air dryers that contact the desiccant with the ambient air. The closed air loop passes air from a heater to the humidifier and back and forth between the humidifier and dehumidifier 2 to 6 times before being returned to the heater. A second objective of the present invention is to provide a method for extracting freshwater from ambient air using the HDH system.

BRIEF SUMMARY OF THE INVENTION

According to a first aspect, the present disclosure relates to a closed-air, closed-desiccant (CACD) humidifier-dehumidifier atmospheric water generator system, comprising:

- an air dryer system comprising
  - a desiccant delivery line,
  - a desiccant return line,
  - a strong desiccant,
  - a weak desiccant,
  - a plurality of air dryers connected in series, each comprising a dryer desiccant inlet, a dryer desiccant outlet, an air inlet, an air outlet, and a contacting chamber;
  - a humidifier-dehumidifier (HDH) system comprising
  - a desiccant bypass line connected to the desiccant delivery line of the air dryer system and the desiccant return line of the air dryer system,
  - a dehumidifier comprising
    - a dehumidifier desiccant inlet connected to the desiccant delivery line of the air dryer system,
    - a dehumidifying chamber,
    - a humidified air cooling apparatus connected to the dehumidifier desiccant inlet and placed inside of the dehumidifying chamber,
    - a series of 2 to 6 dehumidifier humidified gas mixture inlets spaced along a dimension of the dehumidifier,
    - a series of 2 to 6 dehumidifier dehumidified gas mixture outlets separated from the series of 2 to 6 dehumidifier humidified gas mixture inlets and spaced along a dimension of the dehumidifier,
    - a dehumidifier desiccant outlet,
    - a gas mixture, and
    - a freshwater outlet;
  - a heater connected to the dehumidifier desiccant outlet;
  - a humidifier comprising
    - a humidifier desiccant inlet connected to the heater,
    - a humidifying chamber connected to the humidifier desiccant inlet,
    - a series of 2 to 6 humidifier dehumidified gas mixture inlets spaced along a dimension of the humidifier and connected to the dehumidifier dehumidified gas mixture outlets, and
    - a series of 2 to 6 humidifier humidified gas mixture outlets separated from the series of 2 to 6 humidifier dehumidified gas mixture inlets and spaced along a dimension of the humidifier and connected to the dehumidifier humidified gas inlets, and
    - a humidifier desiccant outlet connected to the humidifying chamber and the desiccant return line of the air dryer system.

In some embodiments, the strong desiccant is an aqueous solution comprising lithium chloride at a concentration of 0.341 to 0.40 kg lithium chloride per kg of solution.

In some embodiments, the weak desiccant is an aqueous solution comprising lithium chloride at a concentration of 0.25 to 0.340 kg lithium chloride per kg of solution.

In some embodiments, the air dryer system comprises 2 to 20 individual pack-bed dryers configured in series such as to pass multiple aliquots of ambient air over a single aliquot of desiccant.

In some embodiments, the system further comprises a heat exchanger placed along the return line between the desiccant pathway outlet of the HDH system and the air dryer system such that the heat exchanger cools the strong desiccant as it flows from the HDH system to the air drier system.

In some embodiments, the strong desiccant is cooled to a temperature of 20 to 40° C.

In some embodiments, the heater heats the weak desiccant to a temperature of 70 to 90° C. before the weak desiccant passes into the humidifier.

In some embodiments, the system has an adjustable ratio of the desiccant mass flowrate to the air mass flowrate of 3.0 to 16.

In some embodiments, the adjustable ratio of the desiccant mass flowrate to the air mass flowrate is adjusted by changing the desiccant mass flowrate, the air mass flowrate, or both.

In some embodiments, the system has a gained output ratio, defined as the ratio of the product of a mass of freshwater generated by the system times a vaporization latent heat of the freshwater to an amount of heat used to heat the weak desiccant, of 6 to 110.

The present disclosure also relates to a method of extracting freshwater from ambient air comprising:

passing a flow of ambient air over an air dryer system comprising a strong desiccant to produce dry air and a weak desiccant;

heating the weak desiccant to produce a heated desiccant;

cycling a gas mixture, the cycling comprising humidifying a dehumidified gas mixture using a humidifier comprising the heated desiccant to produce a humidified gas mixture and to regenerate the strong desiccant;

dehumidifying the humidified gas mixture using a dehumidifier by cycling the humidified gas mixture from the humidifier to the dehumidifier to produce freshwater and a dehumidified gas mixture;

collecting the freshwater; and returning the strong desiccant to the air dryer system; wherein the cycling of the humidified gas mixture from the humidifier to the dehumidifier and the dehumidified gas mixture from the dehumidifier to the humidifier does not mix the humidified gas mixture with the dehumidified gas mixture and does not mix the humidified gas mixture or the dehumidified gas mixture with ambient air.

In some embodiments, the cycling is performed 2 to 6 times.

In some embodiments, the strong desiccant is an aqueous solution comprising lithium chloride at a concentration of 0.341 to 0.40 kg lithium chloride per kg of solution.

In some embodiments, the weak desiccant is an aqueous solution comprising lithium chloride at a concentration of 0.25 to 0.340 kg lithium chloride per kg of solution.

In some embodiments, the weak desiccant is heated to 70 to 90° C.

In some embodiments, the method further comprises cooling the strong desiccant before returning the strong desiccant to the air dryer system.

In some embodiments, the strong desiccant is cooled to a temperature of 20 to 40° C.

In some embodiments, the ratio of the desiccant mass flowrate to the air mass flowrate is adjustable and is of 3.0 to 16.

In some embodiments, the adjustable ratio of the desiccant mass flowrate to the air mass flowrate is adjusted by changing the desiccant mass flowrate, the air mass flowrate, or both.

In some embodiments, the method has a gained output ratio, defined as the ratio of the product of a mass of freshwater generated by the system times a vaporization latent heat of the freshwater to an amount of heat used to heat the weak desiccant, of 6 to 110.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 7B shows the GOR for enthalpy pinch from 18 to 22 $\mu kg_a^{-1}$, and FIG. 7C shows the GOR for the enthalpy pinch from 45 to 49 $\mu kg_a^{-1}$;

FIG. 9A depicts the effects on the GOR, FIG. 9B depicts the effects on the water production rate, and FIG. 9C depicts the effects on the desiccant fraction;

FIG. 10A depicts the effects on the GOR, FIG. 10B depicts the effects on the water production rate, and FIG. 10C depicts the effects on the desiccant fraction;

FIG. 11A depicts the effects on the GOR, FIG. 11B depicts the effects on the water production rate, and FIG. 11C depicts the effects on the desiccant fraction;

FIG. 12A depicts the effects on the GOR, FIG. 12B depicts the effects on the water production rate, and FIG. 12C depicts the effects on the desiccant fraction;

FIG. 13A depicts the effects on the GOR, FIG. 13B depicts the effects on the water production rate, and FIG. 13C depicts the effects on the desiccant fraction;

FIG. 14A depicts the effects on the GOR, FIG. 14B depicts the effects on the water production rate, and FIG. 14C depicts the effects on the desiccant fraction;

FIG. 15A depicts the effects on the GOR, FIG. 15B depicts the effects on the water production rate, and FIG. 15C depicts the effects on the desiccant fraction;

FIG. 16A depicts the effects on the GOR, FIG. 16B depicts the effects on the water production rate, and FIG. 16C depicts the effects on the desiccant fraction.

DETAILED DESCRIPTION OF THE INVENTION

Figure 1:
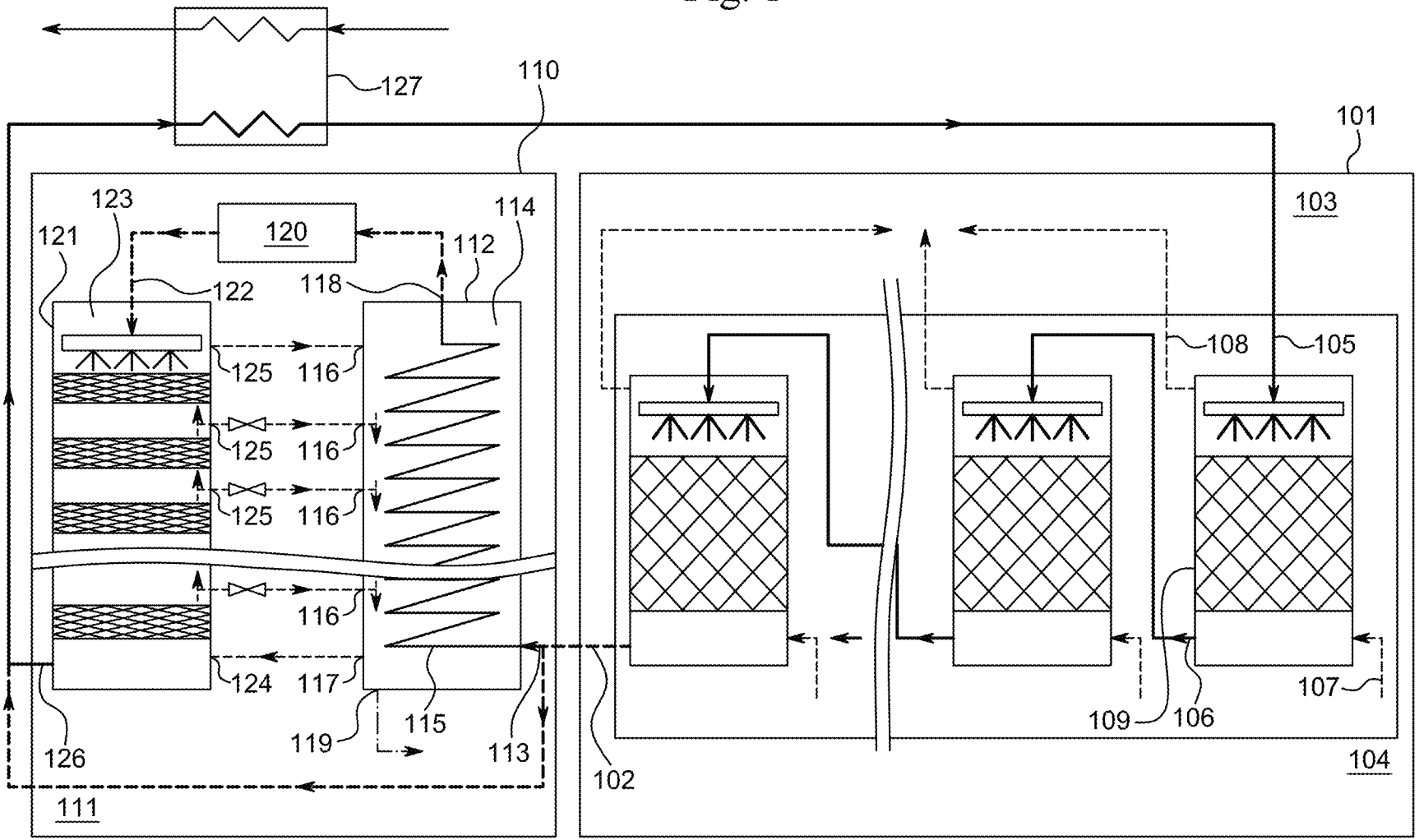
FIG. 1 shows a schematic depiction of the closed-air closed-desiccant based humidifier dehumidifier water generation system with multiple air dryers.

Embodiments of the present disclosure will now be described more fully hereinafter with reference to the accompanying drawings, in which some, but not all embodiments of the disclosure are shown.

The present disclosure will be better understood with reference to the following definitions. As used herein, the words "a" and "an" and the like carry the meaning of "one or more." Within the description of this disclosure, where a numerical limit or range is stated, the endpoints are included unless stated otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the words "about," "approximately," or "substantially similar" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), or +/−20% of the stated value (or range of values). Within the description of this disclosure, where a numerical limit or range is stated, the endpoints are included unless stated otherwise. Also, all values and subranges within a numerical limit or range are specifically included as if explicitly written out.

According to a first aspect, the present disclosure relates to a closed-air, closed-desiccant (CACD) humidifier-dehumidifier (HDH) atmospheric water generator system. This HDH atmospheric water generator system comprises an air dryer system and a humidifier-dehumidifier system. The air dyer system (101) comprises a desiccant delivery line (102), a desiccant return line (103), a strong desiccant, a weak desiccant, a plurality of air dryers connected in series (104), each comprising a dryer desiccant inlet (105), a dryer desiccant outlet (106), an air inlet (107), an air outlet (108), and a contacting chamber (109).

In some embodiments, the air dryer system comprises 2 to 20 individual pack-bed dryers configured in series such as to pass multiple aliquots of ambient air over a single aliquot of desiccant. In some embodiments, a total mass of ambient air passed over a single aliquot of desiccant is adjustable based on parameters such as the ambient air temperature and the ambient air humidity. In some embodiments, the total mass of ambient air passed over a single aliquot of desiccant is adjusted such that the desiccant absorbs a desired amount of water before passing into the HDH system. In some embodiments, the air dryer system is modular, allowing for air dryers to be added and subtracted from the system based on factors such as available power, desired freshwater output, ambient humidity, ambient temperature, and available physical space.

In some embodiments, the air dryer system is configured such that the strong desiccant flows in through the return line and into the dryer desiccant inlet of a first air dryer in the air dryer system. In the contacting chamber, ambient air brought into the contacting chamber through the air inlet contacts the strong desiccant, which absorbs moisture from the ambient air. The ambient air is then expelled through the air outlet and the desiccant is expelled through the dryer desiccant outlet. The desiccant then passes into the dryer desiccant inlet of the next air dryer in the air dryer system. This procedure repeats until the desiccant is expelled from the last air dryer in the air dryer system. Here, having absorbed moisture from the ambient air in each contacting chamber and thus being converted to the weak desiccant, the weak desiccant flows into the desiccant delivery line of the air dryer system. This desiccant delivery line delivers the weak desiccant to the humidifier-dehumidifier system.

The humidifier-dehumidifier (HDH) system (110) comprises a desiccant bypass line (111) connected to the desiccant delivery line of the air dryer system and the desiccant return line of the air dryer system, a dehumidifier (112), a heater (120), a humidifier (121), and a humidifier desiccant outlet (126). The dehumidifier comprises a dehumidifier desiccant inlet (113) connected to the desiccant delivery line of the air dryer system, a dehumidifying chamber (114), a humidified air cooling apparatus (115) connected to the dehumidifier desiccant inlet and placed inside of the dehumidifying chamber, a series of 2 to 6 dehumidifier humidified gas mixture inlets (116) spaced along a dimension of the dehumidifier, a series of 2 to 6 dehumidifier dehumidified gas mixture outlets (117) separated from the series of 2 to 6 dehumidifier humidified gas mixture inlets and spaced along a dimension of the dehumidifier, a dehumidifier desiccant outlet (118), a gas mixture, and a freshwater outlet (119). The heater is connected to the dehumidifier desiccant outlet. The humidifier comprises a humidifier desiccant inlet (122) connected to the heater (120), a humidifying chamber (123) connected to the humidifier desiccant inlet, a series of 2 to 6 humidifier dehumidified gas mixture inlets (124) spaced along a dimension of the humidifier and connected to the dehumidifier dehumidified gas mixture outlets, and a series of 2 to 6 humidifier humidified gas mixture outlets (125) separated from the series of 2 to 6 humidifier dehumidified gas mixture inlets and spaced along a dimension of the humidifier and connected to the dehumidifier humidified gas inlets. The humidifier desiccant outlet is connected to the humidifying chamber and the desiccant return line of the air dryer system.

The weak desiccant, having absorbed moisture from ambient air in the air dryer system, flows into the HDH system. A portion of the weak desiccant is flowed through the desiccant bypass line to the desiccant return line and back to the air dryer system. The remainder of the weak desiccant flows into the dehumidifier desiccant inlet. The amount of weak desiccant that is flowed through the desiccant bypass line relative to the total amount of weak desiccant flowed into the HDH system is adjustable and may range from 0% of weak desiccant flowed into the HDH system to 100% of weak desiccant flowing into the HDH system. The remaining portion of weak desiccant flowing into the HDH system is flowed into the dehumidifier via the dehumidifier desiccant inlet. The amount of weak desiccant flowing into the desiccant bypass line is adjusted to maintain a stable concentration of desiccant for continued operation of the system. The amount of weak desiccant flowing into the desiccant bypass line may be adjusted based on factors such as ambient air temperature, ambient air humidity, and output rate of freshwater from the dehumidifier freshwater outlet. In preferred embodiments, the amount of weak desiccant flowing into the desiccant bypass line is adjusted such that an amount of water produced by the atmospheric water generator system matches the amount of water absorbed from ambient air by the strong desiccant in the air dryer system. In preferred embodiments, the amount of weak desiccant flowing into the desiccant bypass line is adjusted such that the concentration of the desiccant in the desiccant return line does not change as the atmospheric water generator system operates.

A feature of the humidifier-dehumidifier atmospheric water generator system of the present disclosure that distinguishes it from other atmospheric water generator systems or other humidifier-dehumidifier containing systems is the presence of both a closed desiccant loop and a closed gas loop.

The closed desiccant loop refers to a configuration such that the desiccant is regenerated as it cyclically flows through the atmospheric water generator system without a need for continual desiccant addition. The desiccant flows through the atmospheric water generator system in a cyclic manner, the strong desiccant being converted to the weak desiccant in the air dryer system by absorbing water from ambient air, then flowing to the HDH system, where the strong desiccant is regenerated by delivering water to the dehumidified gas mixture. The closed desiccant loop of the atmospheric water generator system is configured such that the strong desiccant flows into the dryer desiccant inlet of a first air dryer in the air dryer system, through the plurality of air dryers where it is converted to the weak desiccant by absorbing water from a flow of ambient air through the air dryers and the weak desiccant then flows out of the dryer desiccant outlet of a last air dryer in the air dyer system into the desiccant delivery line, into humidifier-dehumidifier system with a portion of the weak desiccant flowing into the desiccant bypass line then to the desiccant return line back into the air dryer system and a portion of the weak desiccant flowing into the dehumidifier desiccant inlet, said portion of the weak desiccant flowing through the humidified air cooling apparatus, the dehumidifier desiccant outlet, the heater, the humidifier desiccant inlet, the humidifying chamber where it is converted into the strong desiccant by humidifying the gas mixture in the humidifier, the humidifier desiccant outlet, and the desiccant return line back into the air dryer system. This system allows for the strong desiccant to be regenerated from the weak desiccant and for a cyclic operation that may be advantageous by, for example, minimizing maintenance such as desiccant replenishment.

The closed gas mixture loop refers to a configuration such that the gas mixture is regeneratively converted from the dehumidified gas mixture to the humidified gas mixture as it cyclically flows through the atmospheric water generator system without a need for continual gas mixture addition and without mixing the gas mixture with ambient air. The gas mixture flows through the atmospheric water generator system in a cyclic manner, the dehumidified gas mixture being converted to the humidified gas mixture in the humidifier by absorbing water from the weak desiccant, then flowing to the dehumidifier, where the dehumidified gas mixture is regenerated by the action of the dehumidifier. The closed gas mixture loop of the atmospheric water generator system is configured such that that the gas mixture flows from the humidifier to the dehumidifier and back from 2 to 6 times without the humidified gas mixture coming into contact with ambient air and without the humidified gas mixture flowing from the humidifier coming into contact with the dehumidified gas mixture flowing from the dehumidifier. That is, the gas mixture flows from one of the humidifier humidified gas mixture outlets to one of the dehumidifier humidified gas mixture inlets to the dehumidifying chamber where it is converted into the dehumidified gas mixture, from there to only one of the dehumidifier dehumidified gas mixture outlets to only one of the humidifier dehumidified gas mixture inlets, from there to the humidifying chamber where it is converted to the humidified gas mixture, and from there to a different humidifier humidified gas mixture outlet from the one previously stated, being humidified in the humidifier and dehumidified in the dehumidifier without the gas mixture coming into contact with ambient air. Such a configuration is distinct from open gas mixture or open-air dehumidifier systems, water generation systems, or cooling systems that draw in ambient air to contact a dehumidifier, then expel the dehumidified air. The closed gas mixture loop of the current invention has properties that may be advantageous, such as the ability to use a tailored gas mixture that allows for better performance in a humidifier-dehumidifier cycle, the lack of possible contamination from a continuous supply of external air, or the lack of dedicated air or gas mixture heaters or coolers.

To function as a desiccant, a material must be able to attract water by adsorption or absorption from the surrounding environment. Examples of desiccants include cellulose fibers such as cotton and paper, silica, activated charcoal, zeolites, sugars such as sucrose, lactose, and maltose, honey, caramel, glycerol, organic alcohols such as ethanol and methanol, acids such as concentrated sulfuric acid or concentrated nitric acid, nylon, polycarbonate, poly(methyl methacrylate), acrylonitrile butadiene styrene, polyvinyl alcohol, and hygroscopic salts such as calcium chloride, lithium chloride, magnesium chloride, zinc chloride, cobalt chloride, ferric chloride, potassium carbonate, potassium phosphate, ferric ammonium citrate, ammonium nitrate, potassium hydroxide, and sodium hydroxide. In some embodiments, the strong desiccant is a liquid desiccant. In some embodiments, the liquid desiccant is an aqueous solution of a hygroscopic salt. Such an aqueous solution of a hygroscopic salt must be of an appropriate concentration such that the aqueous solution of a hygroscopic salt still functions as a desiccant, becoming more dilute as water is absorbed. In some embodiments, the strong desiccant is an aqueous solution of a hygroscopic salt that is 74.4 to 100%, preferably 74.5 to 95%, preferably 75 to 90%, preferably 75.5 to 85%, preferably 76 to 80%, preferably 76.25 to 77.5% saturated. In some embodiments, the aqueous solution of a hygroscopic salt comprises lithium chloride. In some embodiments, the lithium chloride is present in the strong desiccant at a concentration of 0.341 to 0.40 kg, preferably 0.342 to 0.39 kg, preferably 0.343 to 0.38 kg, preferably 0.344 to 0.37 kg, preferably 0.345 to 0.36 kg, preferably 0.346 to 0.357 kg, preferably 0.347 to 0.355 kg, preferably 0.348 to 0.353 kg, preferably 0.349 to 0.351 kg, preferably 0.350 kg lithium chloride per kg of aqueous solution. In some embodiments, the weak desiccant is an aqueous solution of a hygroscopic salt. In some embodiments, the weak desiccant is an aqueous solution of a hygroscopic salt that is 50 to 74.25%, preferably 55 to 74%, preferably 60 to 73.5%, preferably 65 to 73%, preferably 70 to 72.5%, preferably 71 to 72.25% saturated. In some embodiments, the aqueous solution of a hygroscopic salt comprises lithium chloride. In preferred embodiments, the weak desiccant is an aqueous solution of lithium chloride having a lithium chloride concentration lower than that of the strong desiccant. In some embodiments, the lithium chloride is present in the weak desiccant at a concentration of 0.25 to 0.340 kg, preferably 0.26 to 0.339 kg, preferably 0.27 to 0.338 kg, preferably 0.28 to 0.337 kg, preferably 0.29 to 0.336 kg, preferably 0.30 to 0.335 kg, preferably 0.31 to 0.334 kg, preferably 0.315 to 0.333 kg, preferably 0.32 to 0.332 kg, preferably 0.325 to 0.331 kg, preferably 0.33 kg lithium chloride per kg of aqueous solution. As used herein, "saturated", when used in the context of an aqueous solution of a hygroscopic salt, refers to an aqueous solution having a maximum amount of hygroscopic salt dissolved in the aqueous solution based on the solubility of the hygroscopic salt under the conditions of the aqueous solution (e.g. the temperature of the aqueous solution).

In some embodiments, the system further comprises a heat exchanger (127) placed along the return line between the humidifier desiccant outlet (126) of the HDH system and the air dryer system (101) such that the heat exchanger cools the strong desiccant as it flows from the HDH system to the air drier system. In some embodiments, the heat exchanger functions with a flow of coolant through the heat exchanger with which the desiccant flowing through the heat exchanger exchanges heat. In some embodiments, the coolant is water. In some embodiments, the strong desiccant is cooled to a temperature of 20 to 40° C., preferably 21 to 39° C., preferably 22 to 38° C., preferably 23 to 37° C., preferably 24 to 36° C., preferably 25 to 35° C., preferably 26 to 34° C., preferably 27 to 33° C., preferably 28 to 32° C., preferably 29 to 31° C., preferably 30° C.

In some embodiments, the heater (120) in the HDH system heats the weak desiccant before it passes into the humidifier. The heated weak desiccant both humidifies and heats the gas mixture in the humidifier before the gas mixture passes into the dehumidifier. In some embodiments, the heater heats the weak desiccant to a temperature of 70 to 90° C., preferably 71 to 89° C., preferably 72 to 88° C., preferably 73 to 87° C., preferably 74 to 86° C., preferably 75 to 85° C., preferably 76 to 84° C., preferably 77 to 83° C., preferably 78 to 82° C., preferably 79 to 81° C., preferably 80° before the weak desiccant passes into the humidifier.

In some embodiments, the system has an adjustable ratio of the desiccant mass flowrate to the air mass flowrate. In some embodiments, the ratio of the desiccant mass flowrate to the air mass flowrate is adjusted by changing the desiccant mass flowrate, the air mass flowrate, or both. In some embodiments, the ratio of the desiccant mass flowrate to the air mass flowrate is 3.0:1 to 16:1, preferably 3.1:1 to 15.9:1, preferably 3.2:1 to 15.7:1, preferably 3.3:1 to 15.6:1, preferably 3.4:1 to 15.5:1, preferably 3.5:1 to 15.4:1.

In some embodiments, the system has a freshwater production rate of 40 to 200 $kgh^{-1}$, preferably 45 to 190 $kgh^{-1}$, preferably 50 to 180 $kgh^{-1}$, preferably 55 to 170 $kgh^{-1}$, preferably 60 to 160 $kgh^{-1}$, preferably 65 to 150 $kgh^{-1}$, preferably 70 to 140 $kgh^{-1}$, preferably 75 to 130 $kgh^{-1}$.

In some embodiments, the system has an energy consumption of 20 to 250 kWh, preferably 30 to 225 kWh, preferably 35 to 200 kWh, preferably 40 to 175 kWh, preferably 45 to 150 kWh, preferably 50 to 125 kWh, preferably 55 to 120 kWh, preferably 60 to 110 kWh, preferably 70 to 100 kWh per $m^3$ of freshwater generated.

In some embodiments, the system has a gained output ratio, defined as the ratio of the product of a mass of freshwater generated by the system times a vaporization latent heat of the freshwater to an amount of heat used to heat the weak desiccant, of 6:1 to 110:1.

The present disclosure also relates to a method of extracting freshwater from ambient air comprising passing a flow of ambient air over an air dryer system comprising a strong desiccant to produce dry air and a weak desiccant, heating the weak desiccant to produce a heated desiccant, cycling a gas mixture, the cycling comprising humidifying a dehumidified gas mixture using a humidifier comprising the heated desiccant to produce a humidified gas mixture and to regenerate the strong desiccant, dehumidifying the humidified gas mixture using a dehumidifier by cycling the humidified gas mixture from the humidifier to the dehumidifier to produce freshwater and a dehumidified gas mixture, collecting the freshwater, and returning the strong desiccant to the air dryer system. Said cycling of the humidified gas mixture from the humidifier to the dehumidifier and the dehumidified gas mixture from the dehumidifier to the humidifier does not mix the humidified gas mixture with the dehumidified gas mixture and does not mix the humidified gas mixture or the dehumidified gas mixture with ambient air. This method transfers moisture from ambient air, to a strong desiccant, to a dehumidified gas mixture, to freshwater. The moisture is absorbed from ambient air in the air dryer system, converting the strong desiccant to the weak desiccant. The weak desiccant humidifies a gas mixture in the HDH system, producing a humidified gas mixture and regenerating the strong desiccant, which returns to the air dryer system. The humidified gas mixture is then dehumidified in the dehumidifier to collect the moisture as freshwater.

In some embodiments, the weak desiccant is heated to 70 to 90° C. preferably 71 to 89° C., preferably 72 to 88° C., preferably 73 to 87° C., preferably 74 to 86° C., preferably 75 to 85° C., preferably 76 to 84° C., preferably 77 to 83° C., preferably 78 to 82° C., preferably 79 to 81° C., preferably 80°. This heated weak desiccant transfers heat as well as moisture to the dehumidified gas mixture in the humidifier.

In some embodiments, the cycling is performed 2 to 6 times, preferably 3 to 5 times, preferably 4 times. In some embodiments, the cycling is performed such that during the portion of a single cycle where the dehumidified gas mixture is being humidified and heated by the heated weak desiccant, the temperature of the heated weak desiccant and the gas mixture are chosen such that the difference between the specific enthalpy of the desiccant and the specific enthalpy of the gas mixture is a minimum.

In some embodiments, the method further comprises cooling the strong desiccant before returning the strong desiccant to the air dryer system. In some embodiments, said cooling is achieved by a heat exchanger placed along the desiccant return line as described above.

In some embodiments, the ratio of the desiccant mass flowrate to the air mass flowrate is adjustable as described above. The ratio of the desiccant mass flowrate to the air mass flowrate may be selected based on factors relating to the conditions and operation of the method such as ambient air humidity, ambient air temperature, desired freshwater output rate, and available power.

In some embodiments, the method has a gained output ratio, defined as the ratio of the product of a mass of freshwater generated by the system times a vaporization latent heat of the freshwater to an amount of heat used to heat the weak desiccant, of 6:1 to 110:1, preferably 6.1:1 to 109:1, preferably 6.2:1 to 108:1, preferably 6.3:1 to 107:1, preferably 6.4:1 to 106:1, preferably 6.5:1 to 105:1.

The examples below are intended to further illustrate the design, construction, or configuration of the CACD based HDH atmospheric water generator system and protocols for the method of generating freshwater and are not intended to limit the scope of the claims. Where a numerical limit or range is stated herein, the endpoints are included. Also, all values and subranges within a numerical limit or range are specifically included as if explicitly written out.

Obviously, numerous modifications and variations of the present invention are possible in light of the above teachings. It is therefore to be understood that, within the scope of the appended claims, the invention may be practiced otherwise than as specifically described herein.

All patents and other references mentioned above are incorporated in full herein by this reference, the same as if set forth at length.

Example 1

Figure 2:
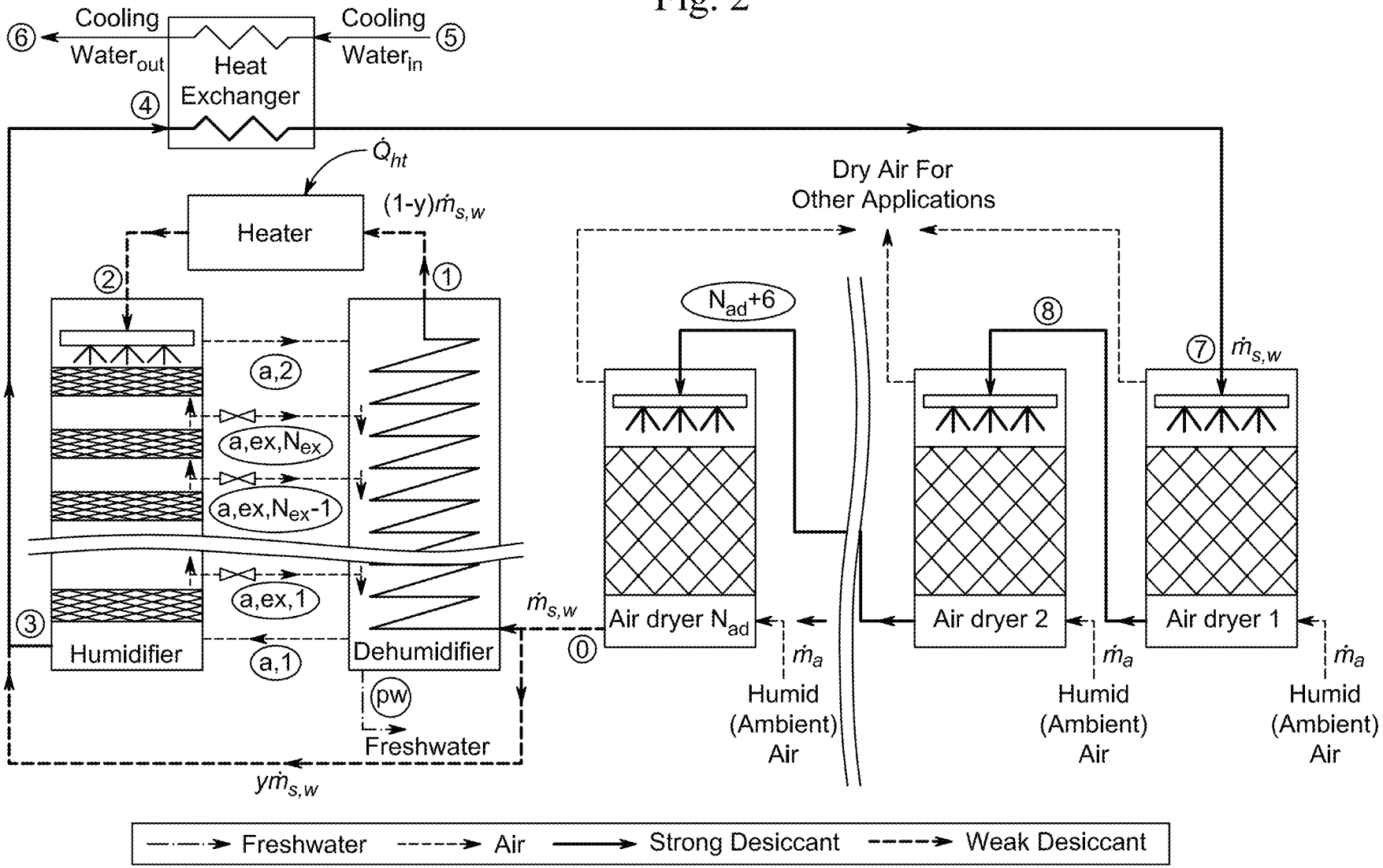
FIG. 2 shows a schematic depiction of the atmospheric water generator system with various flows and states of components specified.

The proposed closed-air closed-desiccant (CACD) based HDH system, including a set of air dryers and multiple extractions (between the system humidifier and dehumidifier), is shown in FIG. 1. The system consists of a dehumidifier, humidifier, heater, heat exchanger, and a set of air dryers. Lithium Chloride (liquid desiccant) can be used as a working fluid that proved to be effective for extracting water content from the humid air [N Fumo, et. al., Sol Energy, 2002; 72:351-361, incorporated herein by reference]. The air dryer should have a sufficient packed area to efficiently exchange the water content from air to the solution. The humidifier consists of three parts: spray nozzle to distribute the hot solution over the second part which is packing material to enhance direct mass and heat transfer between the solution and recirculated air. The third part at the bottom is to collect the strong solution to be pumped to the air dryers after mixing with the by-passed stream (y), as shown in FIG. 2. The dehumidifier is used for condensing water content of the humid air; it may contain copper coils with or without fins through which the cold solution is passed.

It is important to note that the "enthalpy pinch" method is used to evaluate the performance in this paper which is an alternative method to the humidifier and dehumidifier effectiveness. Thus, the size of both humidifier and dehumidifier are variable based on the enthalpy pinch values. Each extraction consists of a small duct (or pipe) with a control valve. A small blower (if needed) can be also used to suck the required amount of air. The same-size of zero-extraction HDH system may be used for multiple extractions, while the cost of extractions is small compared to the humidifier and dehumidifier.

A feature of the system presented here is the multi-extraction of humid air from the humidifier to the dehumidifier (up to five extractions plus infinity extractions are considered). The extracted air from the humidifier is injected to the dehumidifier to the points having the same enthalpy of extraction points to avoid entropy generation due to mixing. FIG. 2 shows the state points as "a,ex,1" for the first extraction and "a,ex, $N_{ex}$" for a number of extractions; where "a" denotes the air, "ex" is the extraction, "$N_{ex}$" is a number of extractions, and "$N_{ax}+1$" is a number of stages. Another feature in the present system is the inclusion of a set of air dryers to improve the water productivity.

The air dryers are used in a series configuration to get a weak solution (state 0) due to absorbing water content from the humid ambient air. A part of the weak desiccant (1−y), coming from the air dryers, is passing through the dehumidifier to help the condensation of a hot-humid air that comes from the humidifier (a, 2, see FIG. 2) resulting in pure water ($\dot{m}_{pw}$) accumulating at the bottom of the dehumidifier. The other part of the weak desiccant (y) goes through a bypass (does not enter the HDH) since the HDH is used to extract the same amount of water content that has been absorbed from the ambient air to keep a cyclically stable operating. The weak desiccant (1−y) leaves the dehumidifier (state 1) and enters the humidifier (state 2) after obtaining considerable heat from the heater. It is sprayed inside the humidifier to increase the mass exchanging area with the recirculated air that is coming from the bottom of the dehumidifier (state a,1). In this case, the desiccant loses some water content and leaves the dehumidifier to be mixed with the bypassed weak solution (y) in order to obtain a strong desiccant at state 3. Then, the strong desiccant solution is cooled to almost ambient temperature (state 7) using cooling water via an unmixed heat exchanger (states 5-6). To complete a cycle, by using a series set of air dryers, the desiccant absorbs water content from the atmospheric air. It passes from state 7 to state 0. The ambient air enters and leaves each air dryer separately.

For thermodynamic balancing implementation, a saturated air is extracted from the humidifier and injected to the dehumidifier using single extraction (only the states a, 1; a,ex,1; and a,2 is connected between the humidifier and dehumidifier) or multiple extractions (a number of states a,ex, $N_{ex}$ are connected), as shown in FIG. 2. The outlet, i.e. state a,2, is always used and it is the only one that is used for zero extraction. The thermodynamic balancing is performed in desiccant-based HDH where the applied heating and water production (mass exchange) are spatially taking place. In addition, the entropy generation in the HDH is high, so that, it is a vital part of the system to be thermodynamically enhanced.

Example 2

Mathematical Modeling To estimate the performance of the present system (see FIG. 2) with and without extractions, some assumptions are considered:

- The solution type is Lithium Chloride (LiCl) which is considered to be stable during the cyclic process [N Fumo, et. al., Sol Energy 2002; 72:351-361, incorporated herein by reference].
- Steady-state processes [SM Zubair, et. al., Desalination, 2018; 436:161-175, incorporated herein by reference].
- The energy required for the air blowers and desiccant pumps have been neglected.
- All system components are well insulated [NAA Qasem, et. al., Desalination, 2019; 461:37-54, incorporated herein by reference].
- The recirculated air between HDH components is saturated.
- The temperature of the produced (condensed) water is considered as an average air temperature of the dehumidifier terminals.
- Thermal equilibrium is applied for the interfaces between air and bulk liquid desiccant in the air dryers [R Kumar, et. al., Int J Curr Eng Technol, 2014; 4:557-563, incorporated herein by reference].

The air dryers and humidifier interfacial surfaces are the same in terms of heat and mass transfer which is achieved by using package materials to increase the surface area of heat and mass transfer.

Performance Index

As usual, the HDH system performance is evaluating in term of gained output ratio (GOR), it is the ratio of the water condensation heat to the total inlet heat, and can be expressed as [MH Sharqawy, et. al., Desalination, 2014; 349:10-21, incorporated herein by reference], $$GOR = \frac{\dot{m}_{pw} h_{fg}}{\dot{Q}_{ht}} \tag{1}$$

The main parameters needed to estimate the system GOR is the following (refer to FIG. 2):

The ratio of strong desiccant mass flowrate to that of the recirculated air (MR).

Temperature and concentration of the strong desiccant solution ($T_7$, $\xi_{s,st}$).

Temperature and humidity of the ambient air ($T_a$, $\phi_a$).

Heating temperature ($T_2$).

Humidifier and dehumidifier enthalpy pinches ($\Psi_{hum}$, $\Psi_{deh}$). Enthalpy pinch is a specific enthalpy that is accounting for the loss in enthalpy of the outlet streams of the humidifier/dehumidifier due to a finite area of heat and mass transfer.

Table 1 listed the typical values of the primary operating conditions.

TABLE 1

Typical and possible values of the system operating condition.

| Parameter | Typical Value | Range |
|---|---|---|
| Desiccant-to-air mass flowrate ratio, MR ($kg_{s,w}$ $kg_a^{-1}$) | Optimal | 3.15-15.4 |
| Strong solution temperature, $T_7$(° C.) | 30 | 20-40 |
| Strong solution concentration, $\xi_7$ ($kg_s$ $kg_{sol}^{-1}$) | 0.35 | 0.35 (fixed) |
| Weak solution concentration, $\xi_0$ ($kg_s$ $kg_{sol}^{-1}$) | 0.33 (for 10 dryers) | 0.31-0.34 |
| Atmospheric Temperature, (° C.) | 30 | 20-40 |
| Atmospheric relative humidity, $\phi_a$ | 0.75 | 0.60-0.90 |
| Heating Temperature, $T_2$ (° C.) | 80 | 70-90 |
| Enthalpy pinch, $\Psi$ (kJ $kg_a^{-1}$) | 20 | 0-100 |

Air Dryer Model

Figure 3:
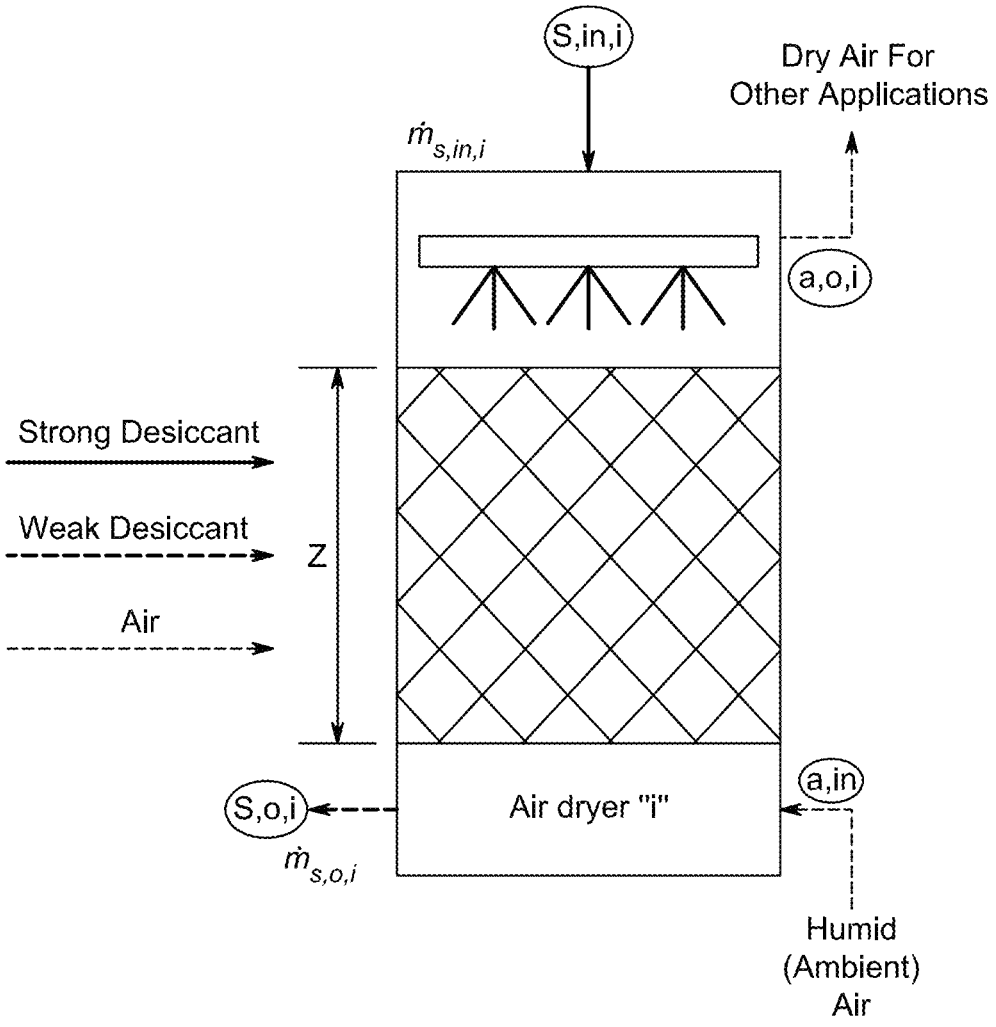
FIG. 3 shows a schematic of a single air dryer.

Both heat and mass are exchanged between the desiccant and ambient air inside each air dryer. A typical packed-bed air-dryer with an indication to the desiccant and ambient air inlets and outlets are shown in FIG. 3. The mass and energy conservation equations of the air dryer (as shown in FIG. 3) are expressed as [V Martin, et. al., HVAC&R Res, 2000; 6:21-39, incorporated herein by reference]:

$$\dot{m}_{s,in,i} - \dot{m}_{s,o,i} = \dot{m}_a(\omega_{a,in} - \omega_{a,o,1}) \tag{2}$$

$$\dot{m}_{s,in,i} h_{in,i} - \dot{m}_{s,o,i} h_{o,i} = \dot{m}_a(h_{a,o,i} - h_{a,in}) \tag{3}$$

$$(1-\xi_{s,in,i})\dot{m}_{s,in,i} + \dot{m}_a(\omega_{a,in} - \omega_{a,o,i}) = (1-\xi_{s,o,i})\dot{m}_{s,o,i} \tag{4}$$

The amount of water extracted from the atmospheric air is written as, $$\dot{m}_{pw} = \Sigma_{i=1}^{N_{ad}} \dot{m}_a(\omega_{a,in} - \omega_{a,o,i}) \tag{5}$$

The heat transfer in the air dryer depends on the temperature and concentration differences. It can be expressed in terms of inlet and outlet enthalpies of the atmospheric air.

$$\Delta H_{a,i,max} = \dot{m}_a(h_{a,in} - h_{a,o,i,id}) \tag{6}$$

The air dryer energy effectiveness can be defined as the energy difference of air or desiccant to the maximum enthalpy difference of the air [GP Narayan, et. al., Front Heat Mass Transf 2010; 1, incorporated herein by reference]. That is:

$$\dot{m}_{s,in,i} = \frac{\Delta \dot{H}_{a,i}}{\Delta \dot{H}_{a,i,max}} = \frac{(h_{a,in} - h_{a,o,i})}{(h_{a,in} - h_{a,o,i,id})} \tag{7}$$

where $h_{a,o,i,id}$ is the ideal enthalpy of the air, which is taken at the inlet desiccant temperature.

Similarly, the humidity effectiveness can be defined as the ratio of actual air humidity ratio difference between the air outlet and inlet to that with considering the maximum humidity difference.

$$\varepsilon_{mt,i} = \frac{(\omega_{a,in} - \omega_{a,o,i})}{(\omega_{a,in} - \omega_{a,o,i,id})} \tag{8}$$

The ideal humidity ratio, $\omega_{a,o,id}$ is obtained when the driving force that is necessary for the mass transfer is zero, i.e. the partial pressure of water vapor is equal to that in the inlet liquid desiccant.

Moreover, both the energy and humidity effectiveness can be also calculated using proper correlations.

$$\varepsilon_{mt,i}, \varepsilon_{ht,i} = 1 - C_1(\dot{m}_{s,in,i}/\dot{m}_a)^a (h_{a,in}/h_{s,in,i})^b (a_t Z)^c \tag{9}$$

where $$a = k_1(\gamma_{s,in,i}/\gamma_{s,cr}) + m_1 \tag{10}$$

$$c = k_2(\gamma_{s,in,i}/\gamma_{s,cr}) + m_2 \tag{11}$$

Here, the non-dimensional ratios ($\dot{m}_{s,in,i}/\dot{m}_a$. $h_{a,in}/h_{s,in,i}$ $a_t Z$, and $\gamma_{s,in,i}/\gamma_{s,cr}$) are used to generalize the correlations of energy and humidity effectiveness as suggested by Oberg [V Öberg, PhD Dissertation, University of Florida; 1998, incorporated herein by reference] using the Buckingham-Pi theorem. $h_{a,in}$ is the specific enthalpy of the inlet air, $h_{s,in,i}$ is the specific enthalpy of the desiccant solution at the air dryer inlet, $a_t$ is the specific surface area of packing material, Z is the height of packing material, $\gamma_{s,in,i}$ is the wettability of the desiccant solution at the inlet of the air dryer, and $\gamma_{s,cr}$ is the critical surface tension of the packing materials. The constants $C_1$, b, $k_1$, $k_2$, $m_1$, and $m_2$ are listed in Table 2. Moreover, Chung et al. [TW Chung, et. al., Sep Sci Technol 1993; 28:533-550, incorporated herein by reference] conducted some experiments to determine a range of dimensionless parameters that were previously investigated by [V Öberg, et. al., J Sol Energy Eng Trans ASME, 1998; 120: 289-297, incorporated herein by reference; and TW Chung, et. al., Sep Sci Technol 1995; 30:1807-1832, incorporated herein by reference] as listed in Table 3.

TABLE 2

Coefficients used in the effectiveness correlations.

| Effectiveness | $C_1$ | b | $k_1$ | $m_1$ | $k_1$ | $m_2$ |
|---|---|---|---|---|---|---|
| $\varepsilon_{mt,\,i}$ | 48.3 | −0.751 | 0.396 | −1.57 | 0.0331 | −0.906 |
| $\varepsilon_{ht,\,i}$ | 3.77 | −0.528 | 0.289 | −1.12 | −0.0044 | −0.365 |

TABLE 3

Operating limits of the non-dimensional ratios used for the effectiveness correlation.

| Non-Dimensional Ratio | Range |
|---|---|
| $MR(\text{dryer}) = \frac{\dot{m}_{s,in,i}}{\dot{m}_a}$ | 3.5-15.5 |
| $\frac{h_{a,in}}{h_{s,in,i}}$ | 0.4-1.9 |
| $a_tZ$ | 84-262 |
| $\frac{\gamma_{s,in,i}}{\gamma_{s,cr}}$ | 0.8-3.2 |

The properties of the moist air have been estimated from the formulations of Hyland and Wexler [R W Hyland, & A W Wexler, ASHRAE Trans, 1983; 500-519, incorporated herein by reference] while those of desiccant by Conde [MR Conde, Int J Therm Sci, 2004; 43:367-382, incorporated herein by reference]. The performance of air dryers is robustly evaluated by the energy and mass effectiveness as formulated in Eqs. (7) and (8). Moreover, some methods were reported in the literature including heat and mass transfer coefficients [Y Yin, et. al., Int J Heat Mass Transf, 2016; 93:1218-1226, incorporated herein by reference], surface density [MV Rane, et. al., Appl Therm Eng, 2005; 25:769-781, incorporated herein by reference], desiccant materials efficiency [MG Salazar, et. al., Energy Build, 2018; 162:187-197, incorporated herein by reference].

Humidifier-Dehumidifier Model

The mass and energy conservation equations for the desiccant HDH components are written as [GP Narayan, et. al., Desalin Water Treat, 2010; 16:339-353, incorporated herein by reference]:

Humidifier $$(1-y)\dot{m}_{s,w}-\dot{m}_{d,deh}(\omega_{a,2}-\omega_{a,1})=\dot{m}_{s,st}-y\dot{m}_{s,w}) \tag{12}$$

$$(1-y)\dot{m}_{s,w}h_1-\dot{m}_{d,deh}(h-h_{a,1})=(\dot{m}_{s,st}-y\dot{m}_{s,w})h_3 \tag{13}$$

Dehumidifier $$\dot{m}_{pw}-\dot{m}_{d,deh}(\omega_{a,2}-\omega_{a,1}) \tag{14}$$

$$(1-y)\dot{m}_{s,w}(h_1-h_0)+\dot{m}_{pw}h_{pw}=\dot{m}_{d,deh}(h_{a,2}-h_{a,1}) \tag{15}$$

Desiccant Heater $$\dot{Q}_{ht}=(1-y)\dot{m}_{s,w}(h_2-h_1) \tag{16}$$

Enthalpy Pinch and Energy Effectiveness

The enthalpy pinch of the humidifier and dehumidifier is introduced to study the thermodynamic balancing of the system. The enthalpy pinch model is preferred than the temperature pinch for involving both the heat and mass exchanges. This model is demonstrated in FIG. 4 to understand the simultaneous heat and mass exchanges in both the humidifier and the dehumidifier. The circulated humid air is represented in the curved line (a, 1–a,2). The liquid desiccant processes through the dehumidifier and the humidifier are represented by lines (0-1) and (2-3), respectively. The dashed lines denote the ideal states in which the humid air would have reached an infinite-size dehumidifier. Thus, the enthalpy pinch of the dehumidifier can be expressed as:

$$\Psi_{deh}=h_{a1}-h_{a1'} \tag{17}$$

whereas the humidifier enthalpy pinch is the smallest distance between the air curve and line 2-3, $$\Psi_{hum}=h_{tan}-h_{tan'} \tag{18}$$

The enthalpy pinch is related to the dehumidifier and humidifier effectiveness as the following:

$$\varepsilon_{deh} = \frac{\Delta h}{\Delta h + \Psi_{deh}} \tag{19}$$

$$\varepsilon_{deh} \approx \frac{\Delta h}{\Delta h + \Psi_{hum}} \tag{20}$$

It is important to note that the heat capacity ratio (HCR) for a heat exchanger can be expressed as, $$HCR = \frac{\dot{H}_{max,cold}}{\dot{H}_{max,hot}} = \frac{\Delta h + \Psi_{cold}}{\Delta h + \Psi_{hot}} \tag{21}$$

Since the Δh is equal, the HCR=1 when enthalpy pinch of the cold and hot streams are equal. Under these conditions, the thermal balancing can be obtained [MA Ahmed, et. al., Energy Conyers Manag, 2018; 176:86-98, incorporated herein by reference]. This is key to the thermodynamic balancing method.

Figure 4:
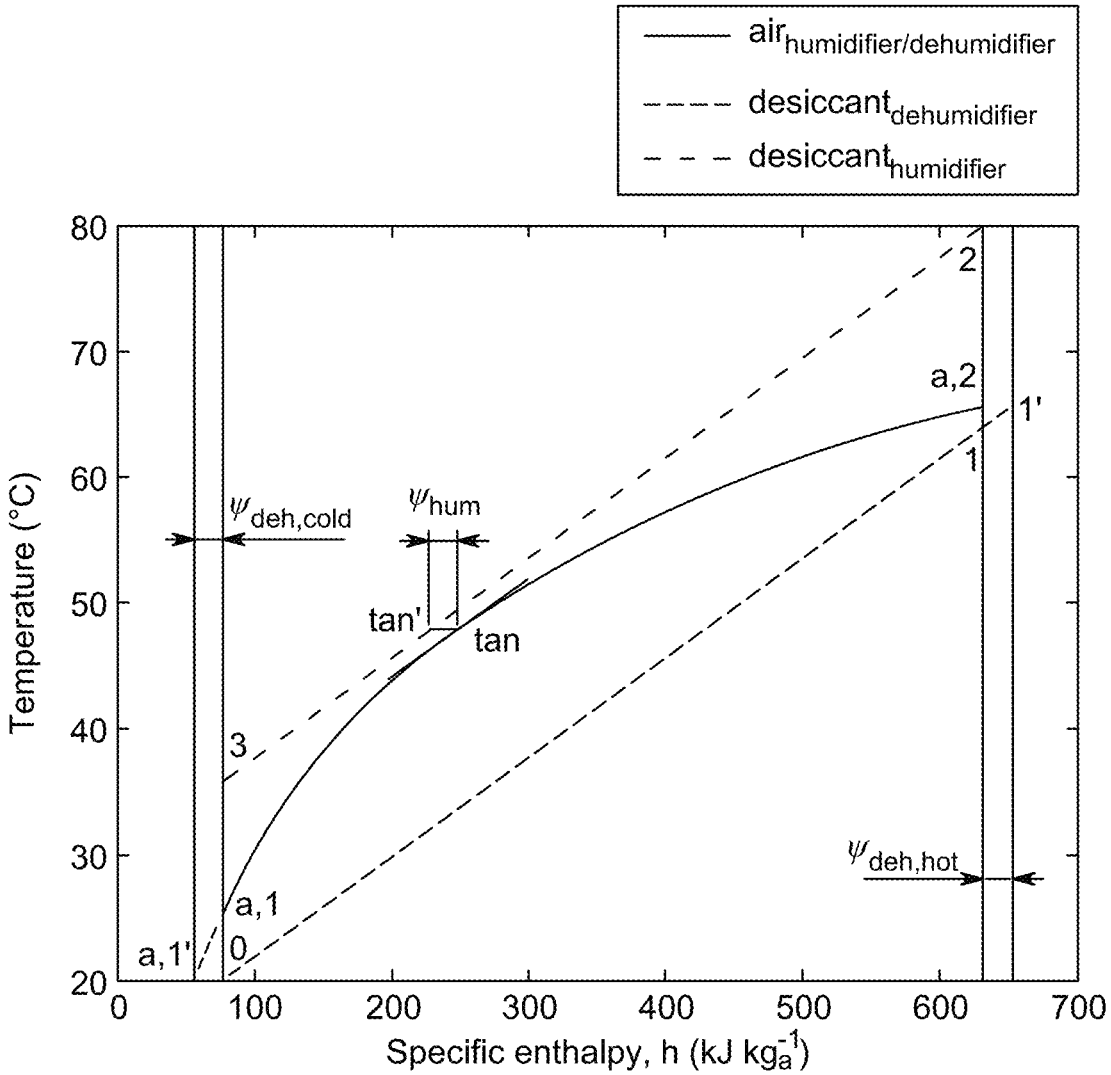
FIG. 4 shows a plot of the thermodynamic balancing of the desiccant HDH system using the temperature-enthalpy profile for zero-extraction.
Figure 5:
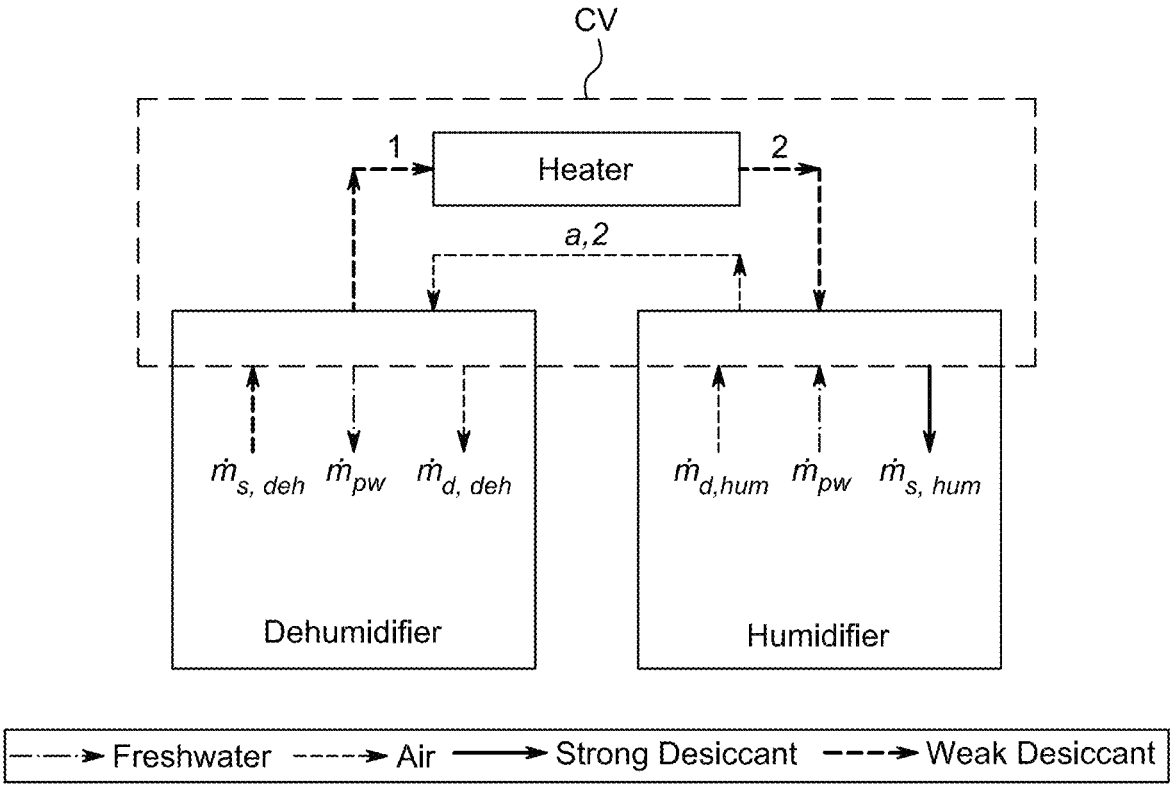
FIG. 5 shows a control volume used in the calculation of the optimal desiccant-to-air mass flowrate ratio.

Optimal Desiccant-to-Air Mass Flowrate Ratio The calculation of an optimal desiccant-to-air mass flowrate ratio is based on the desiccant lines slope (e.g., '0-1, and '2-3, see FIG. 4). In order to do that, a control volume containing the heater and segments from the dehumidifier and the humidifier is considered as shown in FIG. 5.

The applied energy balance on this control volume is written as:

$$\Delta\dot{H}_s-\Delta\dot{H}_{pw}=\Delta\dot{H}_{d,deh} \tag{22}$$

or, $$(1-y)\dot{m}_{s,w}(C_{p,av}\Delta T)_s-\dot{m}_{pw}(C_{p,av}\Delta T)_{pw}=\dot{m}_{d,deh}\Delta h_{d,deh} \tag{23}$$

Assuming that the temperature difference in the condensation process is the same as that of the desiccant, Eq. (23) is simplified as:

$$((1-y)\dot{m}_{s,w}-\dot{m}_{pw})C_{p,av}\Delta T=\dot{m}_{d,deh}\Delta h_{d,deh} \tag{24}$$

The enthalpy difference to the temperature difference when a limit of Δh tends to zero can be used to obtain a formula of slope on the air curve (see FIG. 4). That is:

$$\frac{dT}{dh} = \frac{\dot{m}_{d,deh}}{((1-y)\dot{m}_{s,w} - \dot{m}_{pw})C_{p,av}} \tag{25}$$

where $$C_{p,av} = \frac{C_{p,av,s} + C_{p,av,pw}}{2} \tag{26}$$

Hence, the optimal desiccant to air mass flowrate ratio is obtained as:

$$\frac{\text{Desiccant mass}}{\text{Air mass}} = \frac{((1-y)\dot{m}_{s,w} - \dot{m}_{pw})}{\dot{m}_{d,deh}} = \frac{1}{C_{p,av}\frac{dT}{dh}} \tag{27}$$

Zero Extraction

The modeling of the desiccant HDH system depends primarily on FIG. 4 and the slopes (Eq. (25)). The thermodynamic balancing can mathematically be executed by converting FIG. 4 into a model. For zero-extraction, this concept can be shortened into one equation which states that the dehumidifier slope is equal to humidifier slope as expressed in Eq. (28):

$$slp_{deh}=slp_{hum} \tag{28}$$

Here, slp denotes the slope that is further explained in the following expressions:

$$slp_{deh} = \frac{T(@h = h_{a,2}) - T(@h = h_{a,1} - \Psi_{deh})}{\Psi_{deh} + h_{a,2} - h_{a,1}} \tag{29}$$

$$slp_{hum} = \frac{T_2 - T\left(@\frac{dT}{dh} = slp_{deh}\right)}{\Psi_{hum} + h_{a,2} - h\left(@\frac{dT}{dh} = slp_{deh}\right)} \tag{30}$$

$$h_{a,1} = h(@T = T_0) + \Psi_{deh} \tag{31}$$

Based on humid air thermo-physical properties at atmospheric pressure, T(h) and $$T\left(@\frac{dT}{dh}\right)$$

represent the temperature of the saturated air as a function of enthalpy and temperature derivative, respectively. While $$h\left(@\frac{dT}{dh}\right)$$

represents the air enthalpy as a function of temperature derivative.

The operating parameters of the desiccant-based HDH system are the temperature of the desiccant coolant ($T_0$), the desiccant heating (regeneration) temperature ($T_2$), and enthalpy pinch of the humidifier and dehumidifier ($\Psi_{hum}$ and $\Psi_{deh}$). Applying the operating conditions with Eq. (28) to Eq. (31), $h_{a,1}$ and $h_{a,2}$ can be evaluated. From the dehumidifier and humidifier line equations as shown in FIG. 4, the desiccant temperature at dehumidifier and humidifier outlets can be expressed, respectively, using Eqs. (32) and (33):

$$T_1=T_0+slp_{deh}(h_{a,2}-h_{a,1}) \tag{32}$$

$$T_3=T_2-slp_{deh}(h_{a,2}-h_{a,1}) \tag{33}$$

From Eq. (27), the mass flowrate of the recirculated air between the humidifier and dehumidifier can be formulated as:

$$\dot{m}_{d,deh}=slp_{deh}C_{p,av}((1-y)\dot{m}_{s,w}-\dot{m}_{pw}) \tag{34}$$

Multiple Extractions

Figure 6:
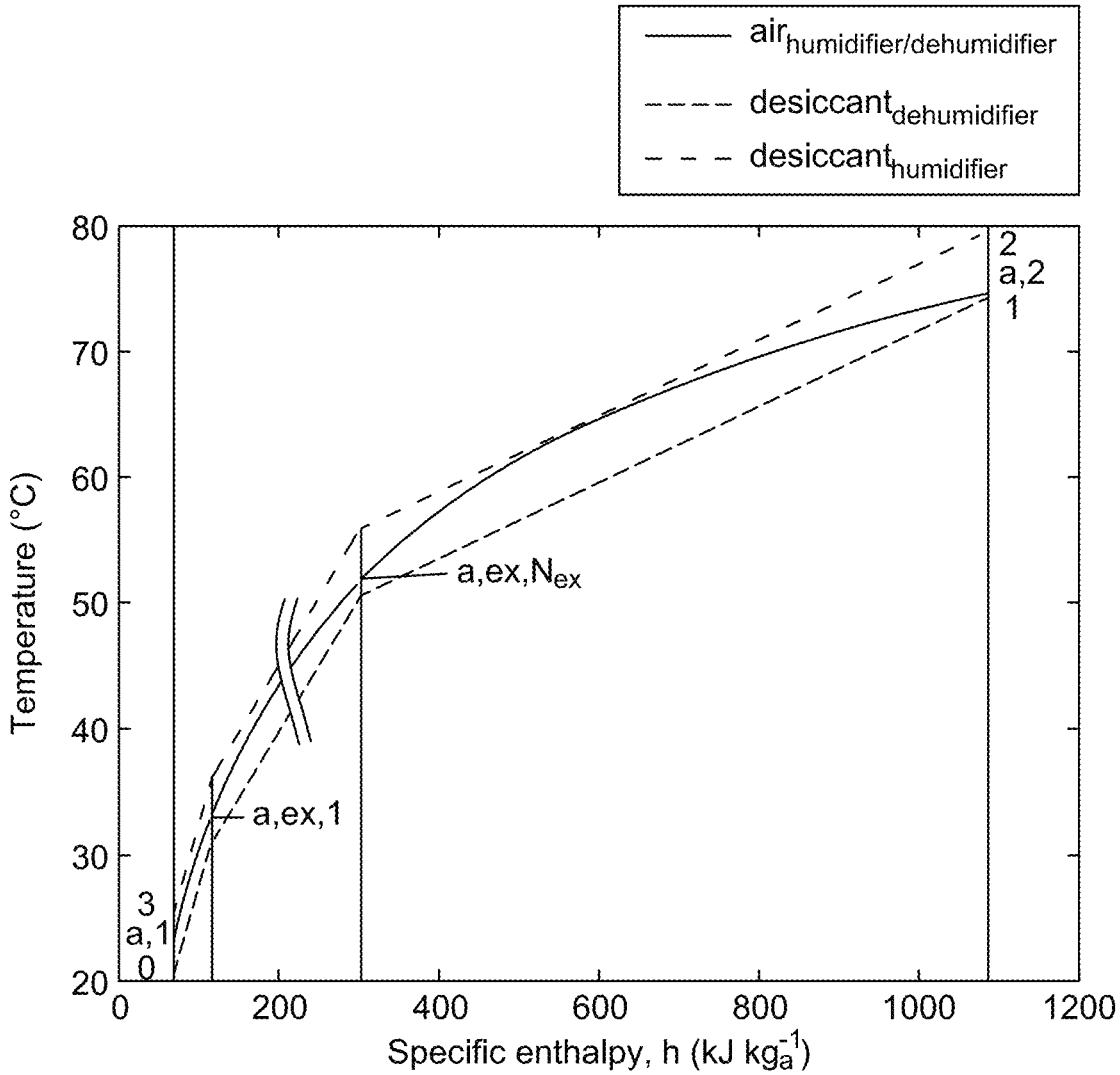
FIG. 6 shows a plot of the thermodynamic balancing using multiple extractions on the desiccant HDH system.

Comparing to the zero extraction, the thermodynamic balancing by applying multiple extractions contains a number of stages. FIG. 6 shows the multi-extraction profile of the desiccant-based HDH system. For each extraction, the entropy generation (due to mixing streams) is avoided by extracting the saturated air from the humidifier to be injected into the dehumidifier at the same enthalpy state (a,ex,i).

The HDH system with '$N_{ex}$' extractions is considered as '$N_{ex}$+1' stages of a zero-extraction. The number of stages is higher than the number of extractions by 1. Therefore, Eqs. (29) and (30) can be applied for all the stages to achieve a thermodynamic balancing for the whole system under multiple extractions. The general formulas for the multi-extraction system are as follows:

$$slp_{deh,i} = slp_{hum,i},\ i = 1 : N_{ex} + 1 \tag{35}$$

where $$slp_{deh,1} = \frac{T(@h = h_{a,ex,1}) - T(@h = h_{a,1} - \Psi_{deh})}{\Psi_{deh} + h_{a,ex,1} - h_{a,1}}$$

$$slp_{deh,i} = \frac{T(@h = h_{a,ex,i}) - T(@h = h_{a,ex,i-1} - \Psi_{deh})}{\Psi_{deh} + h_{a,ex,i} - h_{a,ex,i-1}},\ i = N_{ex} \tag{36}$$

$$slp_{deh,N_{ex}+1} = \frac{T(@h = h_{a,2}) - T(@h = h_{a,ex,N_{ex}} - \Psi_{deh})}{\Psi_{deh} + h_{a,2} - h_{a,ex,N_{ex}}}$$

$$slp_{hum,i} = \frac{T_2 - \sum_{j=1}^{N_{ex}-1} slp_{deh,j+1}(h_{a,ex,j+1} - h_{a,ex,j}) - slp_{deh,N_{ex}+1}(h_{a,2} - h_{a,ex,N_{ex}}) - T\left(@\frac{dT}{dh} = slp_{deh,i}\right)}{\Psi_{hum} + h_{a,ex,i} - h\left(@\frac{dT}{dh} = slp_{deh,i}\right)}$$

$$slp_{hum,N_{ex}+1} = \frac{T_2 - T\left(@\frac{dT}{dh} = slp_{deh,N_{ex}+1}\right)}{\Psi_{hum} + h_{a,2} - h\left(@\frac{dT}{dh} = slp_{deh,N_{ex}+1}\right)} \tag{37}$$

From the dehumidifier and humidifier lines, as shown in FIG. 6, the desiccant temperature at dehumidifier and humidifier outlets can be expressed, respectively, by Eqs. (38) and (39):

$$T_1=T_0+slp_{deh,1}(h_{a,ex,1}-h_{a,1})+\Sigma_{j=2}^{N_{ex}}slp_{deh,j}(h_{a,ex,j}-h_{a,ex,j-1})+slp_{deh,N_{ex}+1}(h_{a,2}-h_{a,ex,N_{ex}}) \tag{38}$$

$$T_3=T_2-slp_{deh,1}(h_{a,ex,1}-h_{a,1})-\Sigma_{j=2}^{N_{ex}}slp_{deh,j}(h_{a,ex,j}-h_{a,ex,j-1})+slp_{deh,N_{ex}+1}(h_{a,2}-h_{a,ex,N_{ex}}) \tag{39}$$

From Eq. (27), the mass flowrate of the recirculated air between the humidifier and the dehumidifier at each stage can be written as:

$$\dot{m}_{d,deh,i}=slp_{deh}C_{p,av,i}((1-y)\dot{m}_{s,w}-\dot{m}_{pw,i}),\ \text{for } i=1:N_{ex}+1 \tag{40}$$

where $$\dot{m}_{pw,1}=\dot{m}_{deh,1}(\omega_{a,ex,1}-\omega_{a,1})$$

$$\dot{m}_{pw,i}=\dot{m}_{deh,i}(\omega_{a,ex,i}-\omega_{a,ex,i-1}),\ \text{for } i=2:N_{ex}$$

$$\dot{m}_{pw,N_{ex}+1}=\dot{m}_{deh,N_{ex}+1}(\omega_{a,2}-\omega_{a,ex,N_{ex}}) \tag{41}$$

The mass flowrate of freshwater produced by multi-extraction HDH system can be expressed as:

$$\dot{m}_{pw}=\Sigma_{j=1}^{N_{ex}+1}\dot{m}_{pw,j} \tag{42}$$

It is important to note that the number of investigated extractions is up to five. The infinite number of extractions is also studied for both the humidifier and the dehumidifier to present the maximum theoretical GOR of the system. However, the infinite-extraction system is not practical and difficult to be achieved in real applications.

The specific energy consumption (kWh per $m^3$ of water production) of the system can be estimated as:

$$E_{sp} = \frac{\rho_{pw}\dot{Q}_{ht}}{3600\dot{m}_{pw}} \tag{43}$$

Example 3

Results and Discussion

First, the models developed in this paper have been validated against some reported data in the literature that shows an excellent agreement between them. The system performance is presented by GOR and freshwater amounts for different operating parameters such as enthalpy pinch, number of air dryers, atmospheric temperature and relative humidity, and the maximum heating temperature under typical conditions (i.e., desiccant strong concentration ($\xi_{st}$) is 35% and the ratio of the desiccant-to-air mass flowrate, MR, is 3.5 (optimal)).

Figure 7A:
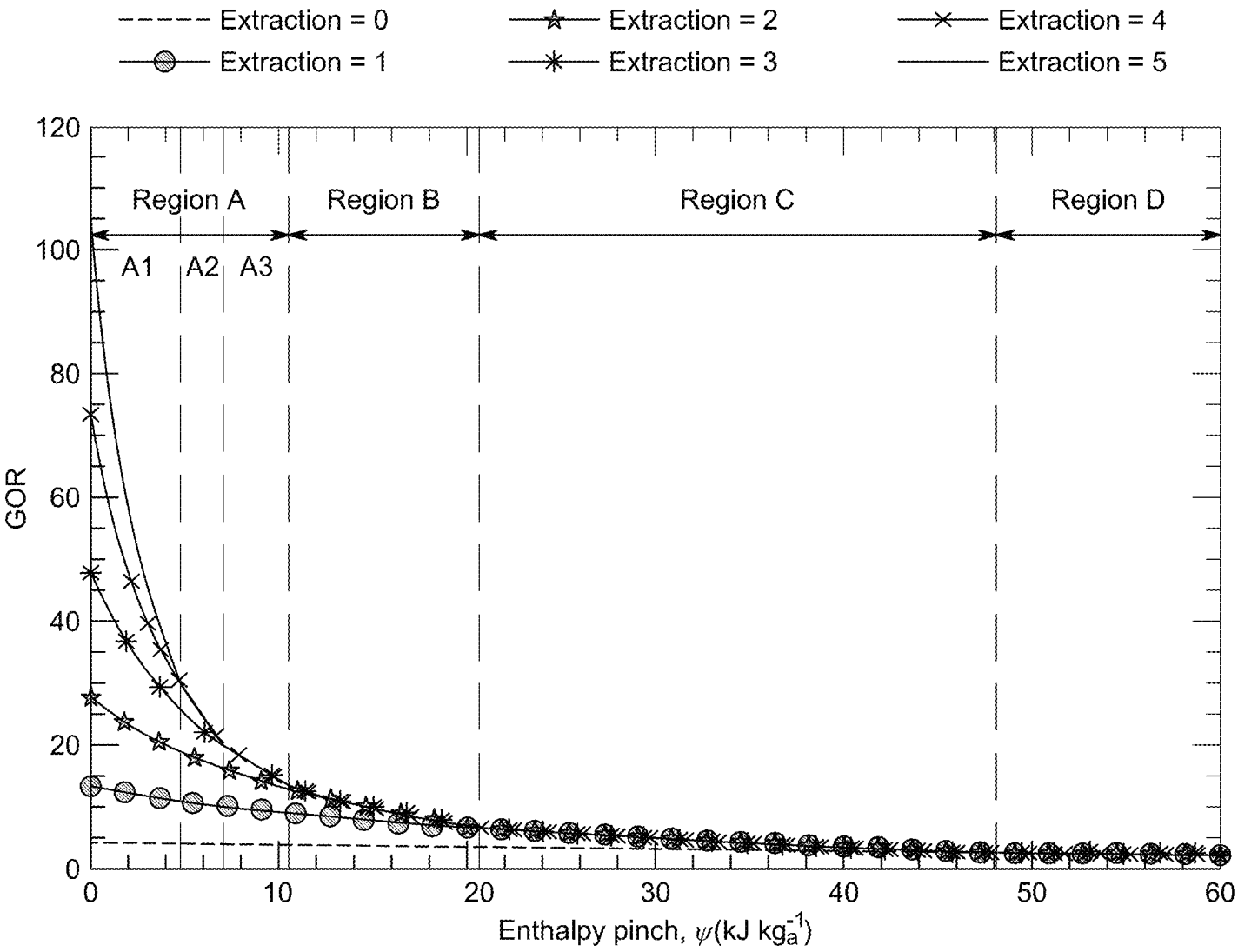
FIG. 7A-7C shows the effects on the system GOR of the enthalpy pinch value for five extraction schemes with FIG. 7A shows the full enthalpy pinch range.
Figure 7B:
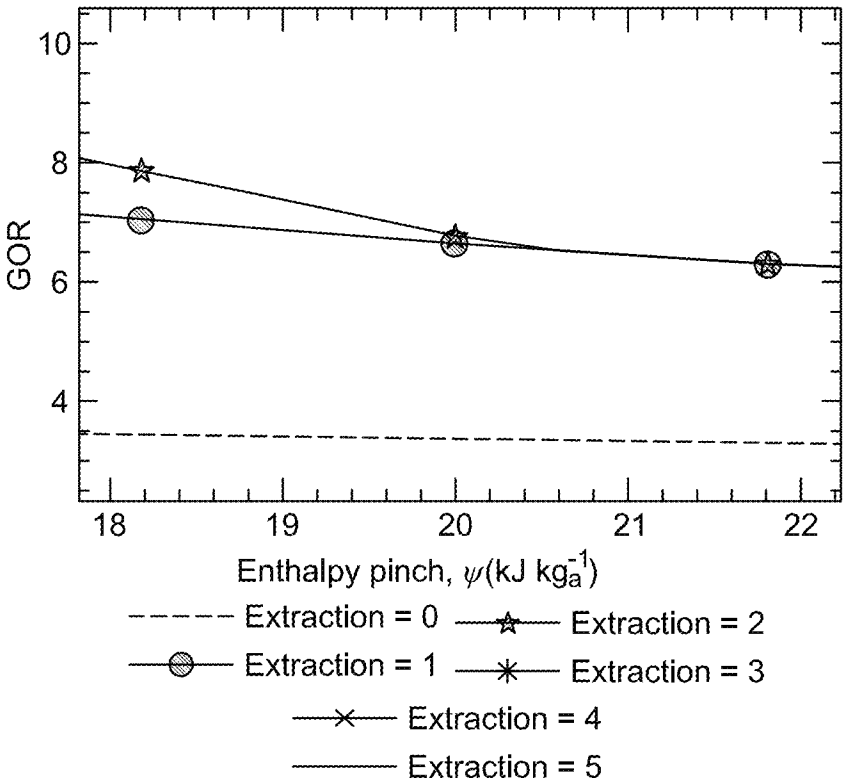
Figure 7C:
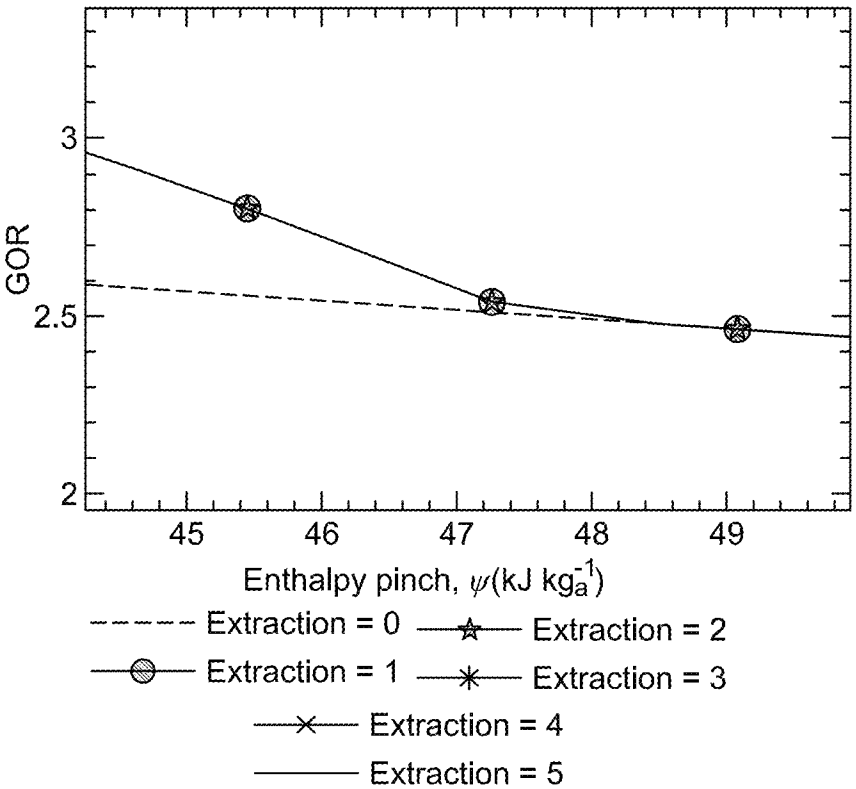

The influence of enthalpy pinch on the system GOR under different extractions (up to five) between the system humidifier and the dehumidifier using ten air dryers is shown in FIG. 7. For enthalpy pinch equal to zero kJ $kg_a^{-1}$ (lowest irreversibility—the reversible system can only be achieved for infinity extractions), the GOR exhibits an interestingly optimal value for each extraction system. It (GOR) is more than 104 for the quintuple extractions, about 73 for the quadruple extractions, about 47 for the triple extractions, about 27 for the double extractions, about 13 for the single extraction, and about 4 for the zero extraction. With decreasing the enthalpy pinch values as in Region A (see FIG. 7), the GOR values decrease dramatically, especially for large extraction numbers. This is attributed to increasing the entropy generation associated with the extractions. The GOR values of quintuple and quadruple extraction systems have similar values (<25.5) when the values of enthalpy pinch are more than 4.7 kJ $kg_a^{-1}$ (see Region A (A1)). Therefore, no need to use five extractions since four of them provide the same performance. For more than 7 and 10.5 kJ $kg_a^{-1}$ enthalpy pinch, the performance enhancements are diminished for four and three extractions, respectively, as shown in FIG. 7, Region A (A2 and A3). The region B ($10.5<\psi<20.6$ kJ $kg_a^{-1}$) shows that the best GOR (between 13.1 and 6.4) are obtained by just applying two extractions. The largest region (Region C) allocates along $20.6<\psi<47.8$ kJ $kg_a^{-1}$, has typical GOR values between 6.4 and 2.4 for the single extraction. For higher enthalpy pinch values (>47.8 kJ $kg_a^{-1}$), all the extractions exhibit the same performance as the zero extraction system; so that, no need to connect any extraction between the humidifier and the dehumidifier.

It is important to note that the present GOR values of 3.7, 11.31, and 23.46 for zero, single, and double extractions, respectively, at zero kJ $kg_a^{-1}$ enthalpy pinch under $T_{max}$=80° C. and $T_{min}$=20° C.; are higher than those for the seawater HDH system with GOR=3, 8.6, and 17.5, respectively, at the same operating conditions [SM Elmutasim, et. al., Desalination, 2018; 435:114-127, incorporated herein by reference]. This is because the evaporated water content in the humidifier is very large for seawater HDH system with respect to those for the desiccant-based HDH system, resulting in an increase of the system entropy generation, thereby decreases the GOR values. Another important point is that the GOR value obtained from the five extractions system at $\psi$=1 kJ $kg_a^{-1}$ is about 76 comparing to about 144 for the infinite extractions that are applied for the dehumidifier or humidifier.

Figure 8:
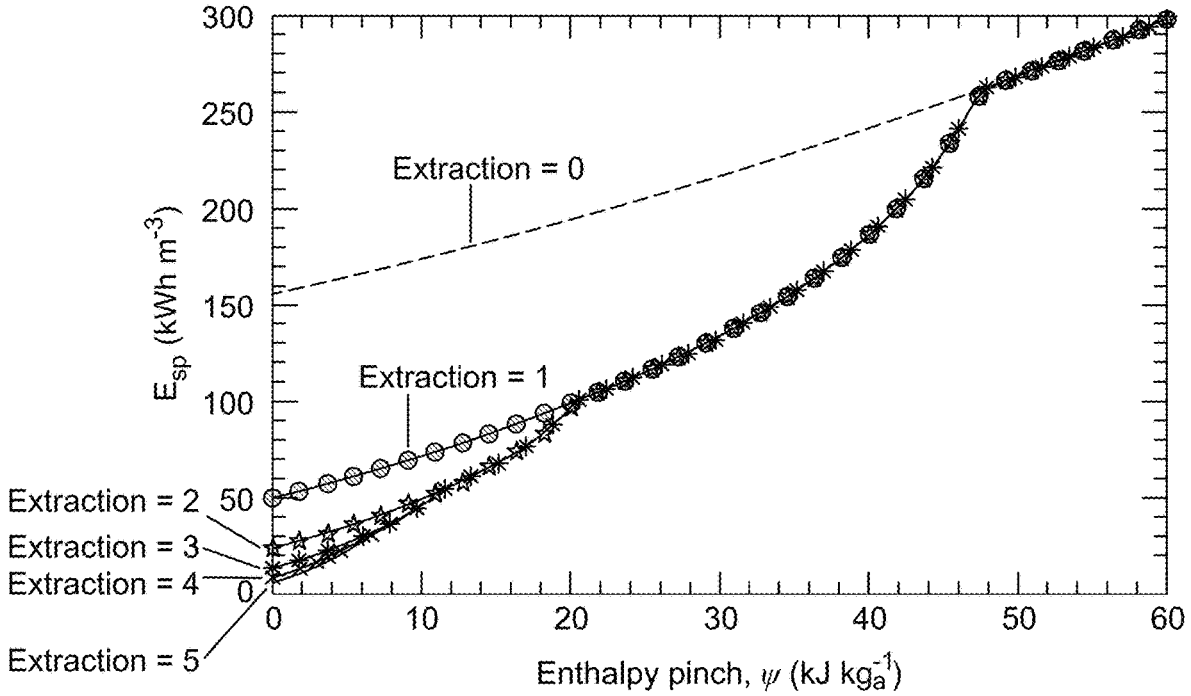
FIG. 8 shows the effects on the specific energy consumption of the system of the enthalpy pinch for five extractions.

It is reported that the energy consumption of CAOW HDH varies between 140 and 550 kWh per unit $m^3$ water production [GP Narayan, Renew Sustain Energy Rev, 2010; 14:1187-1201, incorporated herein by reference]. This range is also valid for the zero extraction desiccant HDH, as shown in FIG. 8. The energy consumption decreases by increasing the number of extractions under a certain range of enthalpy pinch values, similar to those described in FIG. 7. It is also noticed from FIG. 8 that a significant decrease in specific energy consumption values is observed when the enthalpy pinch value decreases due to thermodynamic balancing.

It is important to emphasize that the enthalpy pinch values of 1 and 20 kJ $kg_a^{-1}$ are used in the upcoming results since the first value (1 $kJkg_a^{-1}$) provides a limiting performance for all the extraction schemes, while the second value (20 $kJkg_a^{-1}$) is, so far, proven to be practical.

Figure 9A:
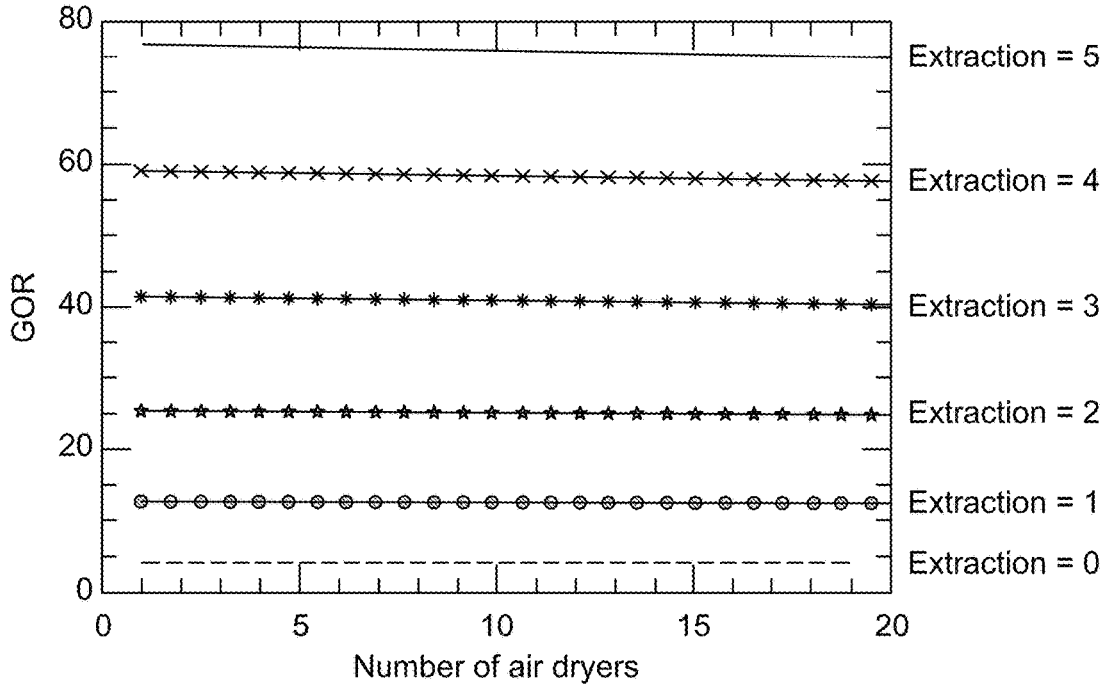
FIG. 9A-9C show the effects of the number of air dryers on the system for an enthalpy pinch of 1 $\mu kg_a^{-1}$, where
Figure 9B:
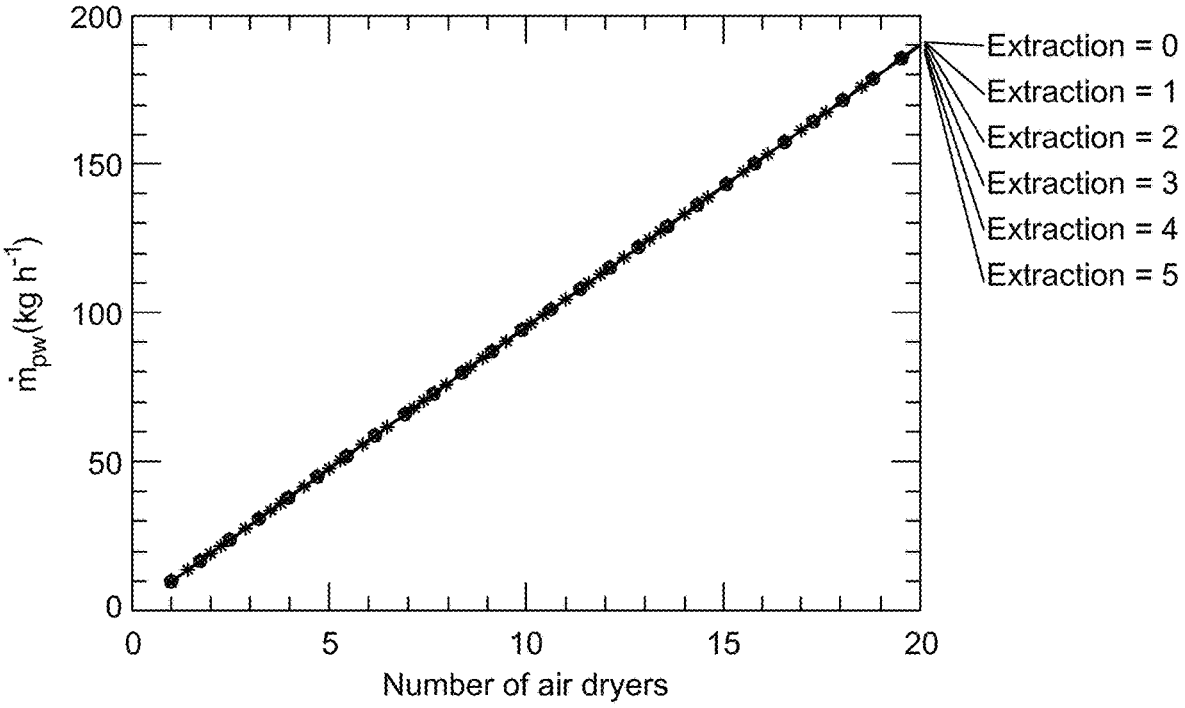
Figure 9C:
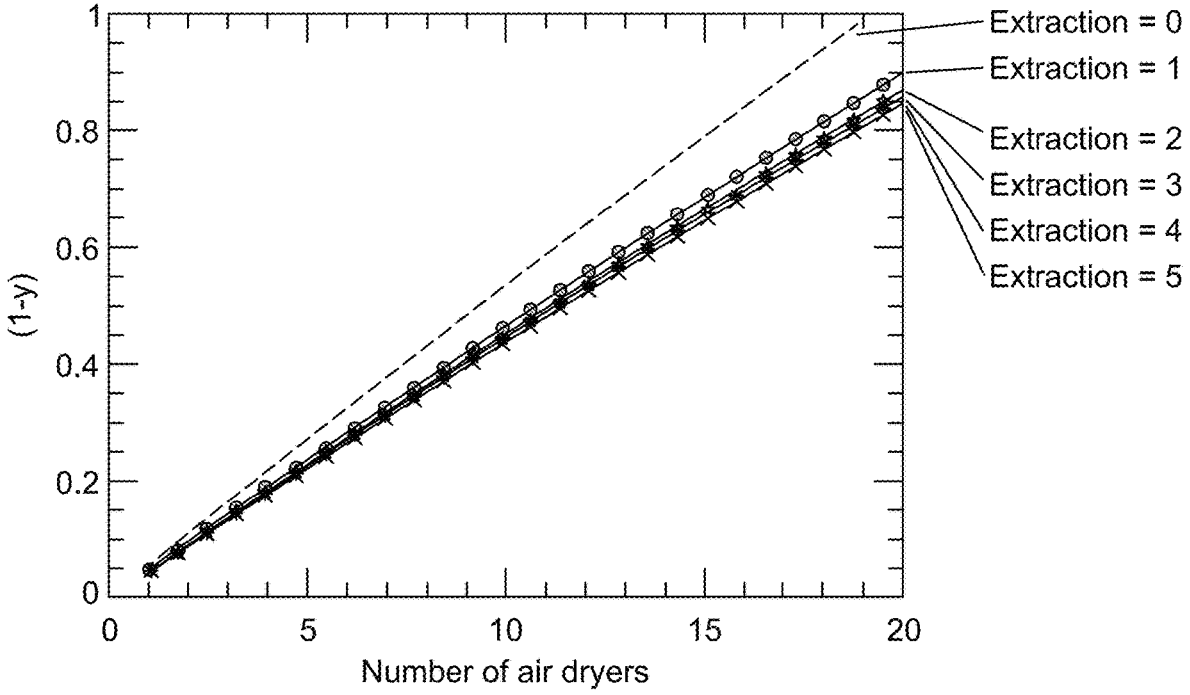

FIG. 9A-9C show the effect of a number of air dryers on the system GOR and produced water amounts for the five extractions schemes when the enthalpy pinch is 1 kJ $kg_a^{-1}$. The number of air dryers is responsible for the amount of water content that is extracted from ambient air. This amount is condensed in the desiccant-based HDH to produce freshwater. The produced water is assumed to be 100% pure water since it is obtained from the condensation process. To have drinkable water, the necessary minerals should be added to the production, as a post-treatment process. The system GOR is almost constant (see FIG. 9A) for a certain extraction scheme while the water production increases (see FIG. 9B). That is because the increase of produced water amount in the HDH (which is the same amount coming from air dryers) is achieved by increasing the desiccant fraction that enters the dehumidifier, as shown in FIG. 9C. For example, for a number of 5 dryers using the triple-extraction system, the GOR and produced water amounts are 41 and 47.45 $kgh^{-1}$, respectively, whereas these values are 40.45 (GOR) and 142.4 $kgh^{-1}$ for 15 air dryers. This behavior is due to increasing the HDH desiccant fraction from 0.2245 to 0.6514 for 5 and 15 air dryers, respectively. The noticeably slight decrease in the GOR values when the number of air dryers increases (for the same extraction system) is because of decreasing the desiccant concentration resulting from increasing the water content. Another point can be drawn from FIG. 9A-9C is that the increase of extractions number improves the GOR values while the produced water amounts are the same, that are the same amounts coming from the air dryers. The weak desiccant fraction needed to condensate the water content inside the HDH decreases with adding a single extraction, but not much for a higher number of extractions. In other words, using the same amount of weak desiccant to be recirculated in the HDH system would produce the same amount of produced water for extractions number more than one. However, the GOR increases due to a significant reduction in the needed input heating due to the thermodynamic balancing. Generally, the system can produce valuable amounts of produced water from 9.5 to 190 $kgh^{-1}$ for 1-20 air dryers, respectively. Simply, water production increases as a function of the number of air dryers. The initial and maintenance costs are expected to be increased. However, if more water is needed, the number of dryers should be increased. Notably, the HDH is capable to condense the water coming from less than 20 dryers for zero extraction and more than 20 dryers for one or more extractions, as shown in FIG. 9C.

It is worth to mention that GOR and specific energy consumption are strong functions of input energy. Like GOR, the specific energy consumption (SEC) is expected to be almost constant against the number of air dryers for the same number of extractions. The energy consumption due to an increase in water content coming from a higher number of air dryers is divided by the same increased amount of water content (Eq. (34)), resulting in the same values of SEC along with the number of dryers.

Figure 10A:
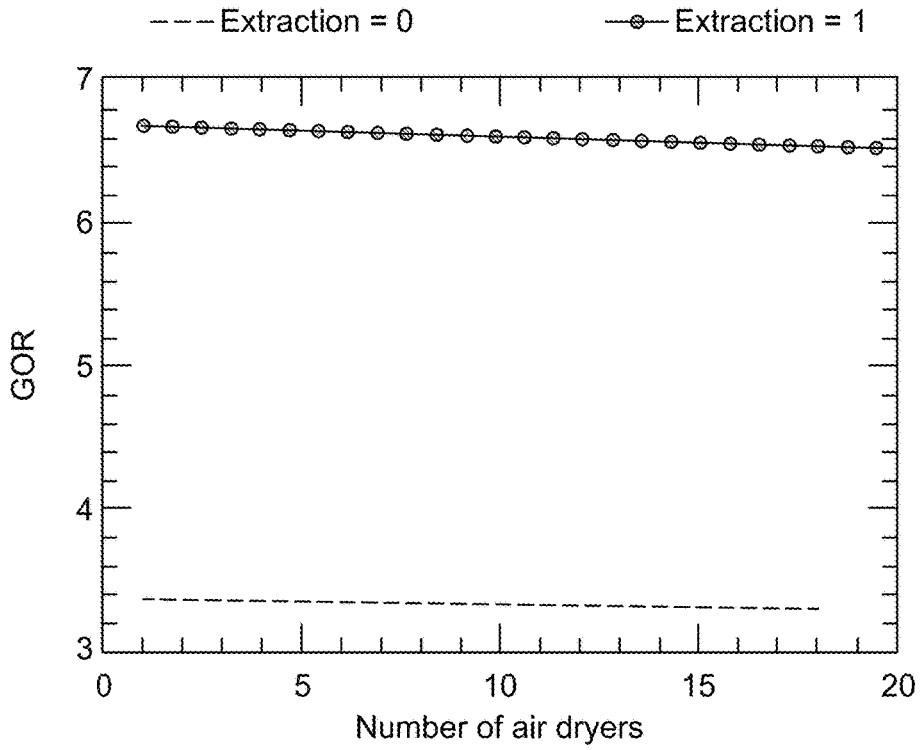
FIG. 10A-10C show the effects of the number of air dryers on the system for an enthalpy pinch of 20 $\mu kg_a^{-1}$, where
Figure 10B:
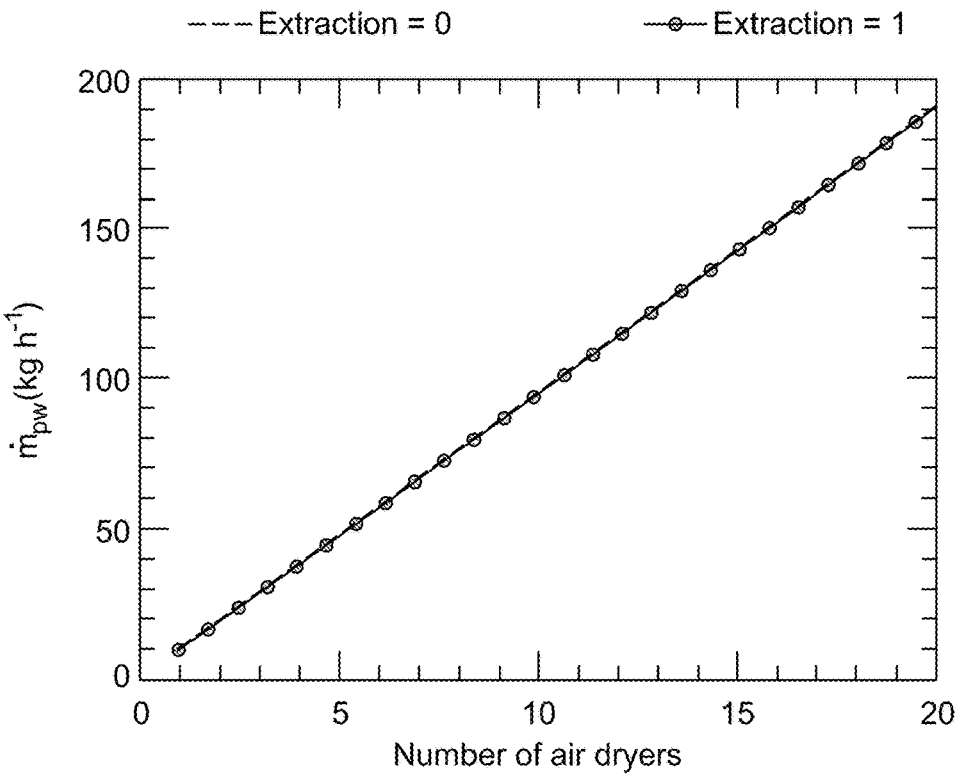
Figure 10C:
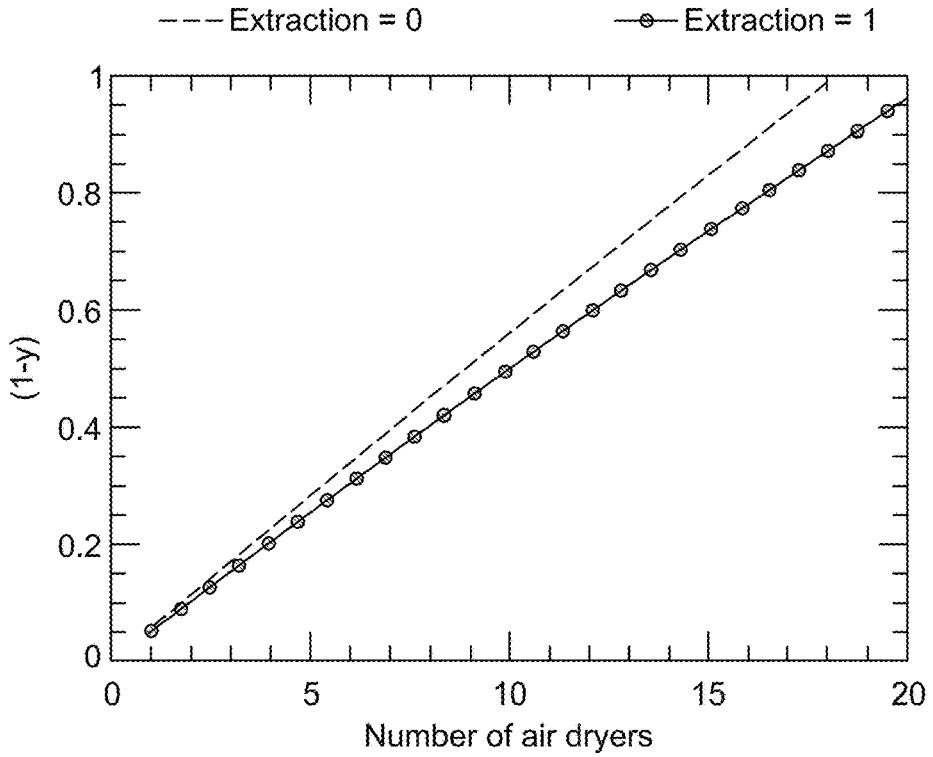

For applying the same operating conditions in FIG. 9A-9C with a typical enthalpy pinch of 20 kJ $kg_a^{-1}$ (this value is suggested in the literature [MA Ahmed, et. al., Energy Conyers Manag, 2018; 176:86-98, incorporated herein by reference] which was reached in the experimental tests [GP Narayan, et. al., Int J Heat Mass Transf, 2013; 58:740-748, incorporated herein by reference]), FIG. 10A-10C shows the effect of number of air dryers on the system performance with only zero- and single-extraction systems (the effect of the higher extractions on the performance is the same as that of the single extraction, see FIG. 7). The GOR values are less than those of $\psi$=1 kJ $kg_a^{-1}$ due to increasing the entropy generation; thus, more heat input is needed. The single extraction system exhibits almost double GOR values (about 6.6) in comparison to the zero extraction (GOR is about 3.3, FIG. 10A) due to enhancing the thermodynamic balancing and reducing the required heating input by almost half. The amount of produced water and weak desiccant fraction are identical to those discussed in FIG. 9A-9C. The weak desiccant fraction values for zero- and single-extraction systems depart by the increase of a number of dryers; it is higher for the zero-extraction scheme.

Figure 11A:
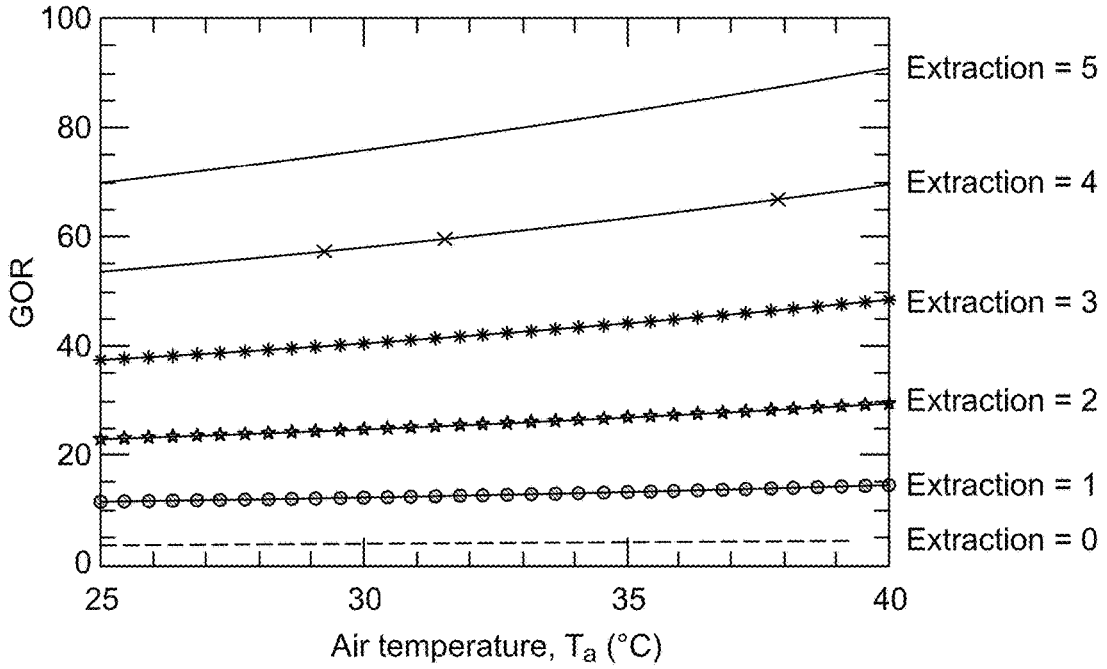
FIG. 11A-11C show the effects of the ambient air temperature on the system for an enthalpy pinch of 1 $\mu kg_a^{-1}$, where
Figure 11B:
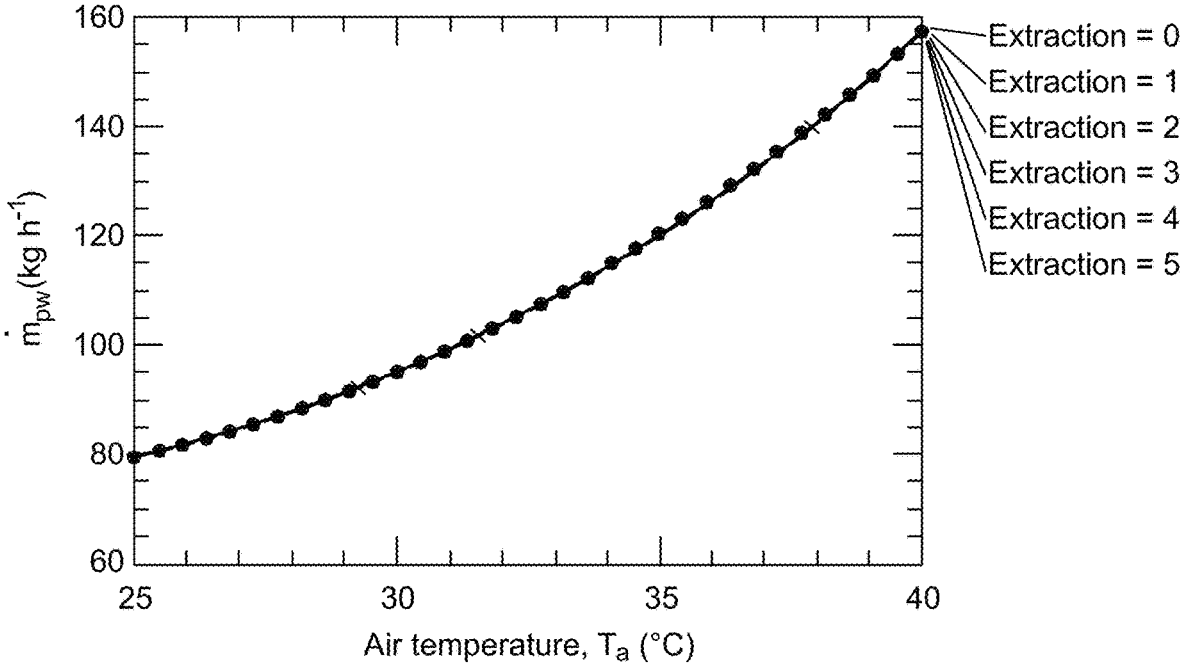
Figure 11C:
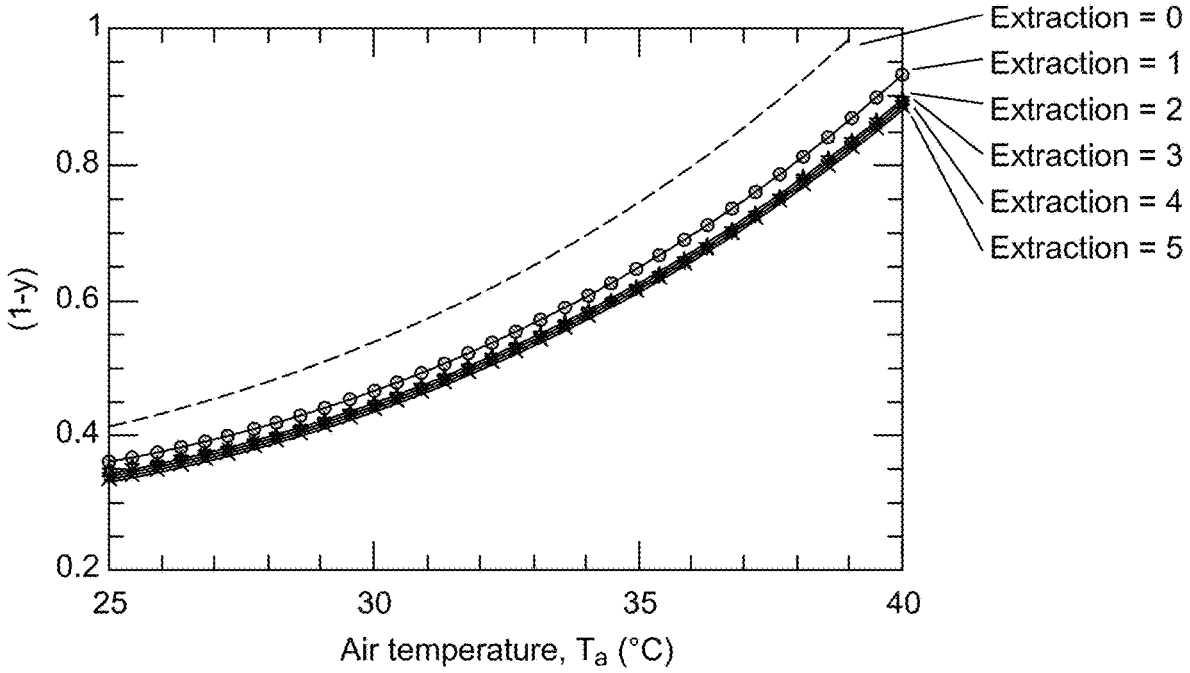

To show the significance of atmospheric air temperature on the system performance at enthalpy pinch of 1 kJ $kg_a^{-1}$ using ten air dryers, FIG. 11A-11C show an increase in both GOR and the produced water values by increasing ambient temperature from 25 to 40° C. GOR reaches more than 100 (for quintuple extractions) at 40° C. The performance enhancement is attributed to the increase of water content in the air at high temperatures (water production increases) and increasing the HDH inlet temperature (heating input decreases leads to enhance GOR). The larger number of extractions enhances the system GOR since lowering the entropy generation. However, the produced water amounts are the same for all extractions configurations as the same water content is coming from the air dryers. Again, the weak desiccant fraction (1−y) has almost the same values for the existence of one extraction (at least) while the system having no extractions required more desiccant fraction to condense all the gained water content. The system can produce 79 up to 156 $kgh^{-1}$ for the ambient temperature of 25-40° C. with an estimated energy consumption of 168.0-142.1 $kWhm^3$ for zero-extraction, 55.9~44.6 kWh $m^{-3}$ for single-extraction, 28.1-22.0 kWh $m^{-3}$ for double-extraction, 17.4-13.5 $kWhm^{-3}$ for triple-extraction, 12.1-9.4 $kWhm^{-3}$ for quadruple-extraction, and 9.4-7.2 $kWhm^{-3}$ for quintuple-extraction, respectively.

Figure 12A:
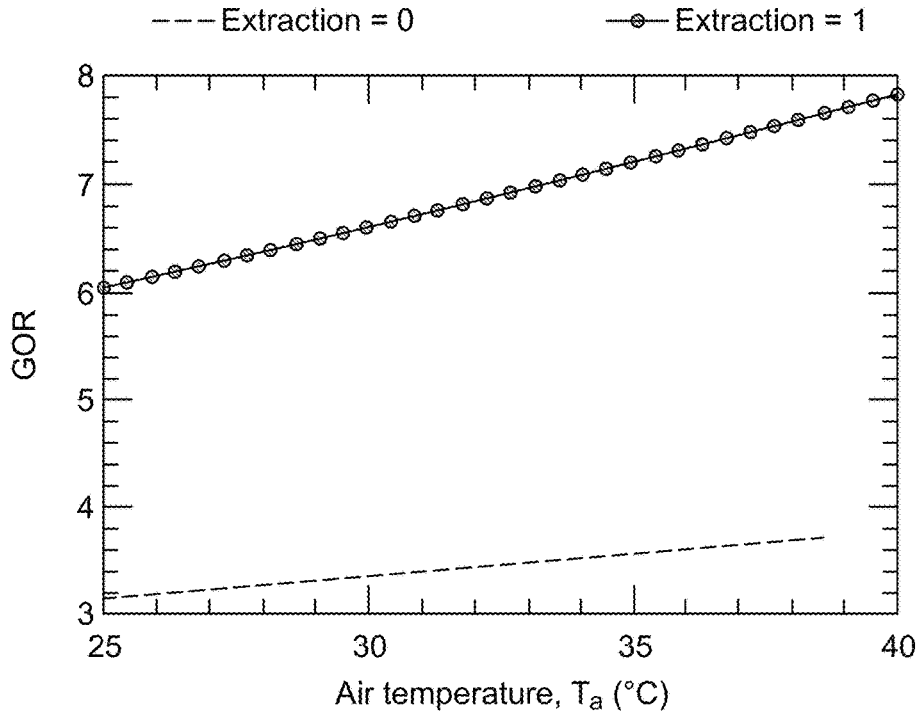
FIG. 12A-12C show the effects of the ambient air temperature on the system for an enthalpy pinch of 20 $\mu kg_a^{-1}$, where
Figure 12B:
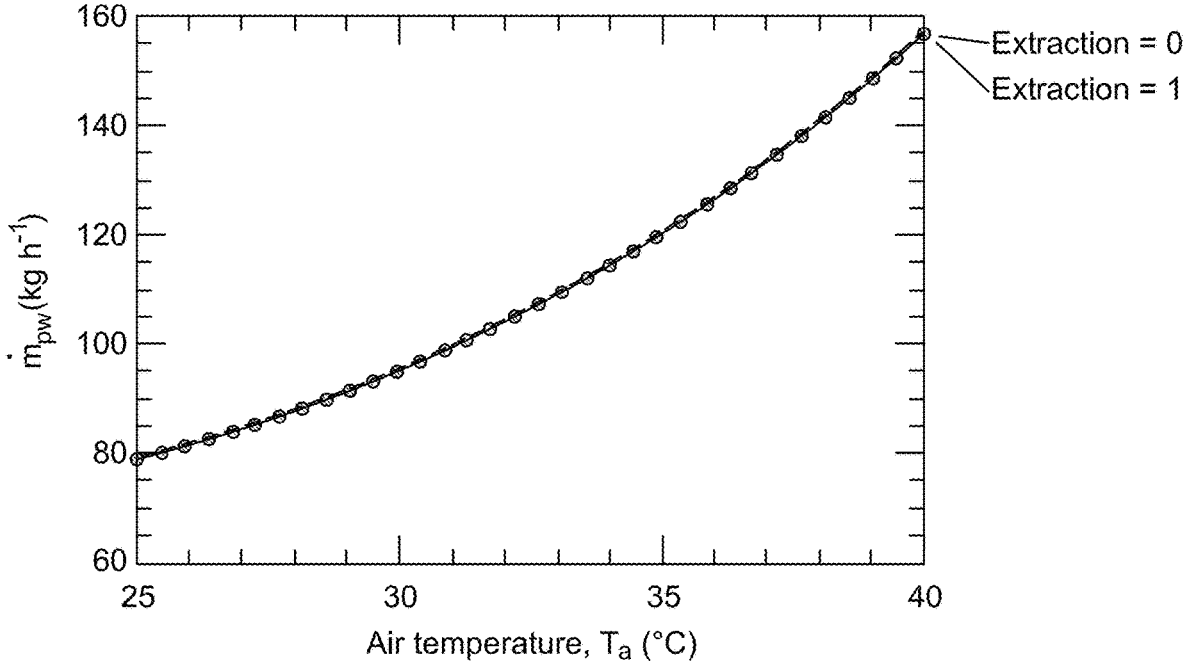
Figure 12C:
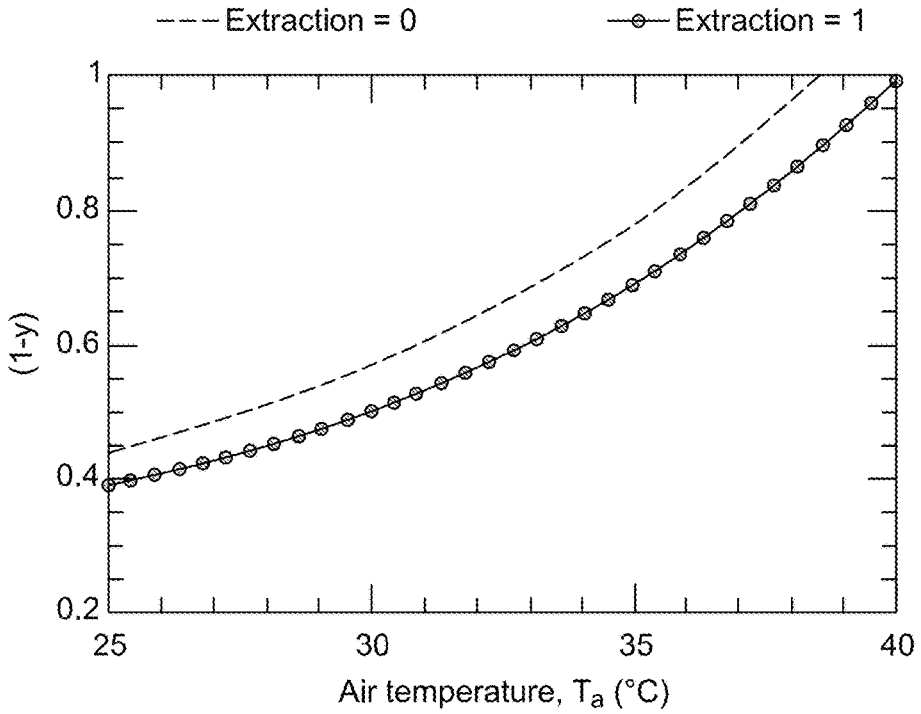

For highlighting performance of the system at a considerably higher enthalpy pinch (e.g., $\psi$=20; the typical value reported in the previous works, which was reached in the experimental work), the zero and single extractions are sufficient as exhibited in FIG. 12A-12C. The GOR values (FIG. 12A) increase from 6 to 8 for the single extraction and from 1.65 to 5.17 for the zero extraction under the air temperature range from 20 to 40° C., respectively. The maximum condensed water is about 156 $kgh^{-1}$ at the inlet air temperature and humidity ratio of 40° C. and 0.75, respectively, with an energy consumption of 174.1 $kWhm^{-3}$ for the single extraction while it is 145 $kgh^{-1}$ with an energy consumption of 83.7 $kWhm^{-3}$ for the zero extraction at the inlet air temperature and humidity ratio of 38.6° C. and 0.75, respectively, as shown in FIG. 12B. This is because the zero extraction system uses all amounts of weak desiccant ((1−y)=1, no bypass) at the inlet air temperature of 38.6° C. (see FIG. 12C); thus, for more than 38.6° C. of the inlet air temperature, the zero-extraction system needs more desiccant amount than those recirculated in the system. The desiccant fraction increases when temperature increases to achieve the same condensate in the HDH to those coming from the air dryers.

Figure 13A:
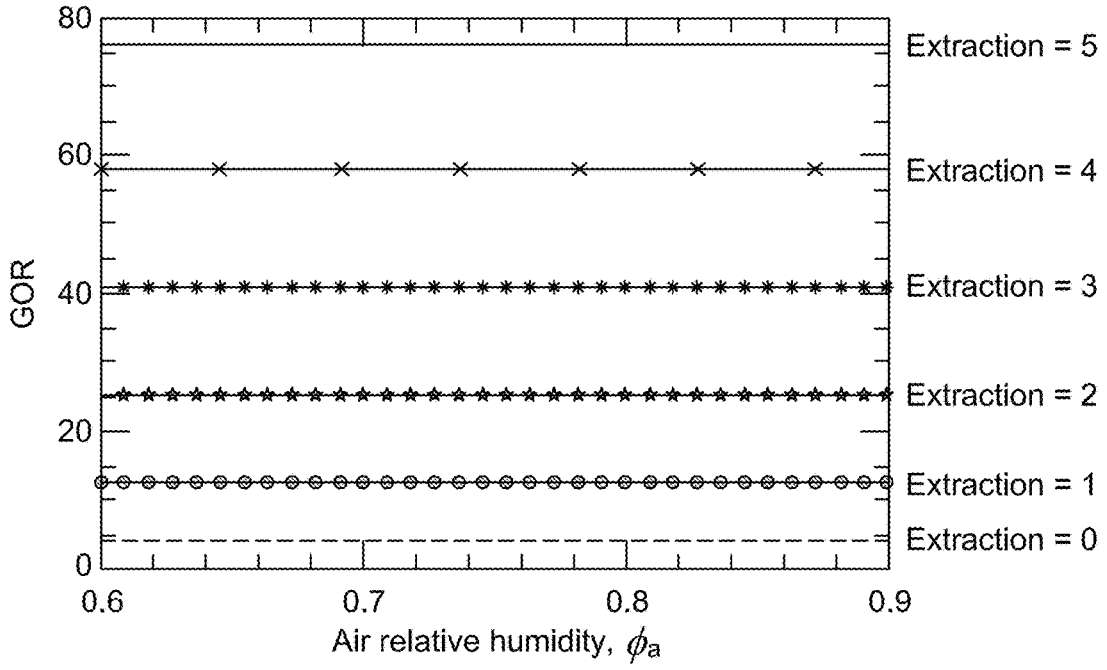
FIG. 13A-13C show the effects of the ambient air humidity on the system for an enthalpy pinch of 1 $\mu kg_a^{-1}$, where
Figure 13B:
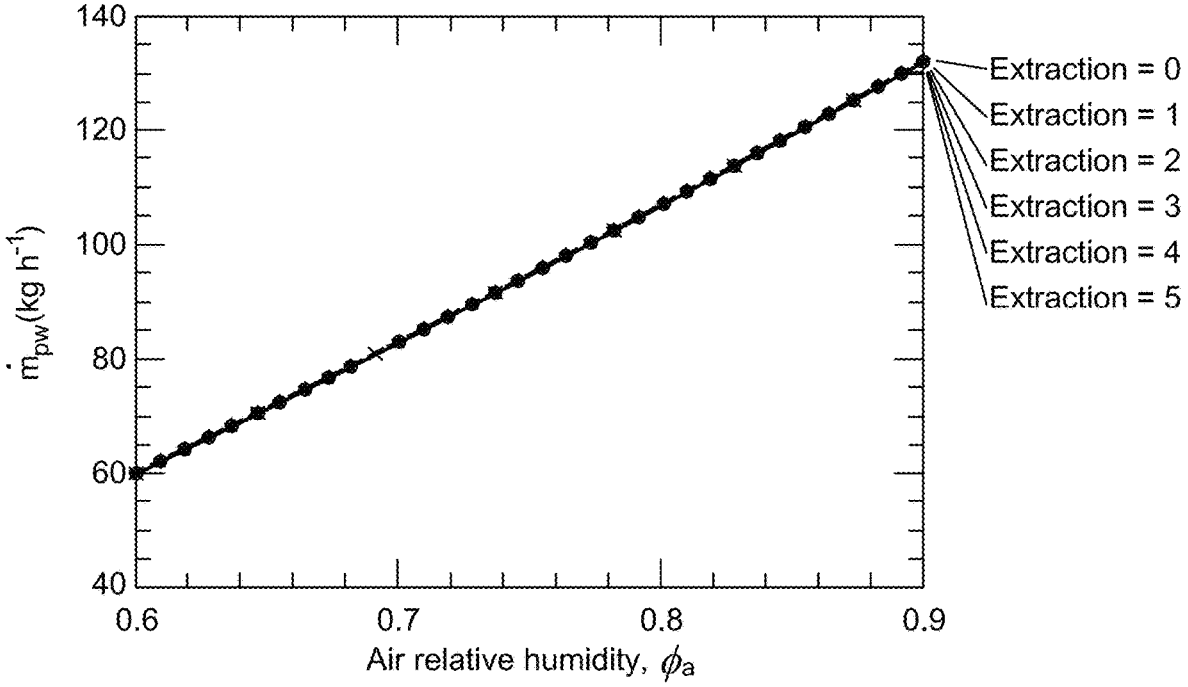
Figure 13C:
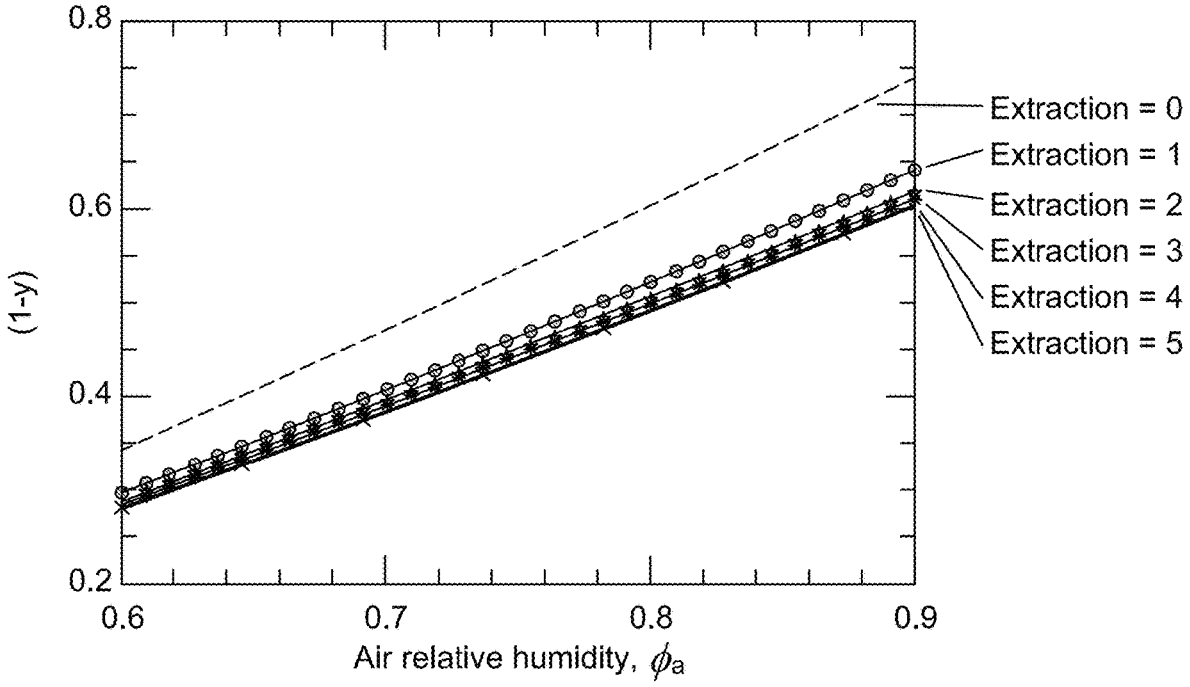

The ambient humidity is an important parameter since it has a substantial impact on the water content extracted from the air dryers. FIG. 13A-13C shows the effect of air relative humidity on the GOR and produced water at an ambient temperature of 30° C. and HDH enthalpy pinch of 1 kJ $kg_a^{-1}$. Despite the water content increases at high relative humidity, the GOR values for each extraction scheme is constant when the relative humidity of the ambient air increases (0.6-0.9) (see FIG. 13A) due to increasing the desiccant fraction that enters the dehumidifier (see FIG. 13C). The water production increases with the increase of the ambient humidity (see FIG. 13B), as the system is imposed to produce the same amounts that are extracted from the ambient air to be cyclically stable. The system (with or without extractions) can produce freshwater from 60 $kgh^{-1}$ at $\Phi_a$=0.6 to about 132 $kgh^{-1}$ at of $\Phi_a$=0.9, both under an ambient temperature of 30° C. However, the GOR values are improved to 4.1, 12.6, 25.18, 40.9, 58.3, and 76.0 when extraction system is zero, single, double, triple, quadruple, and quintuple, respectively. As discussed in previous figures, this improvement is due to minimizing the irreversible losses as a result of applying multiple extractions.

Figure 14A:
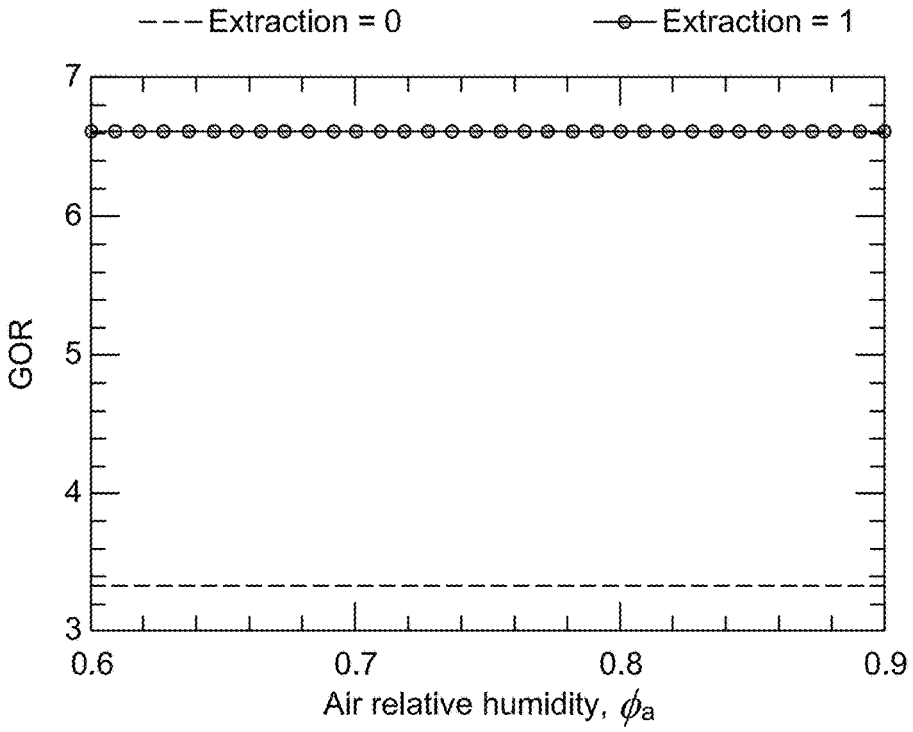
FIG. 14A-14C show the effects of the ambient air humidity on the system for an enthalpy pinch of 20 $\mu kg_a^{-1}$, where
Figure 14B:
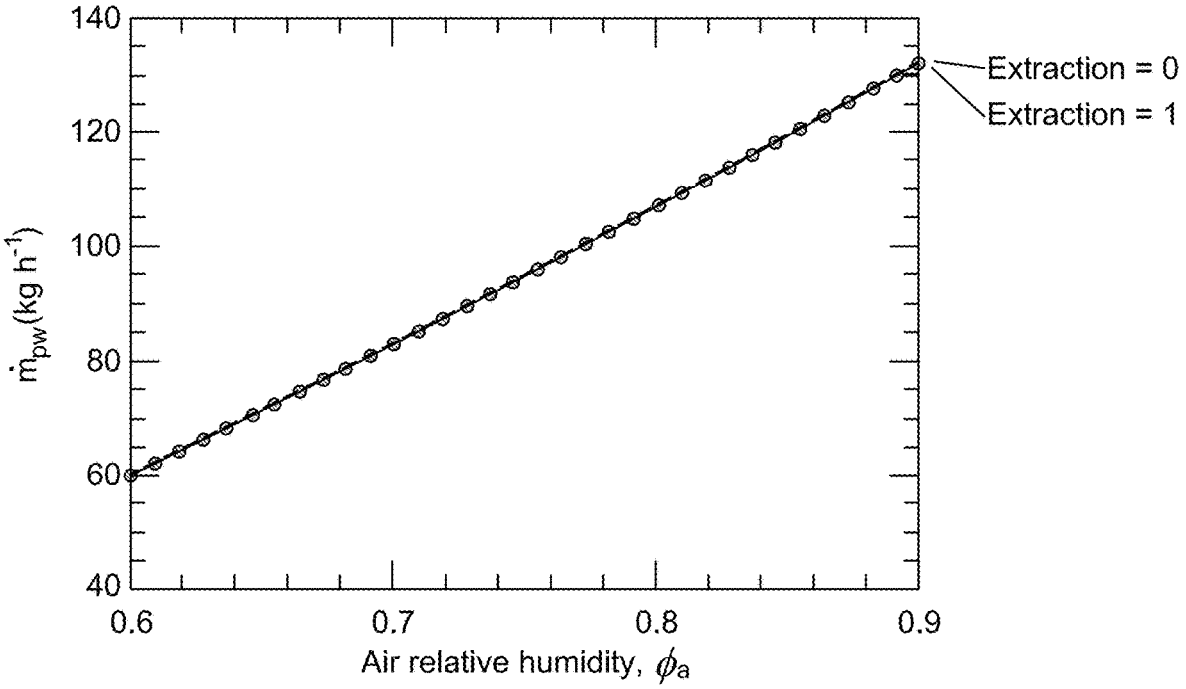
Figure 14C:
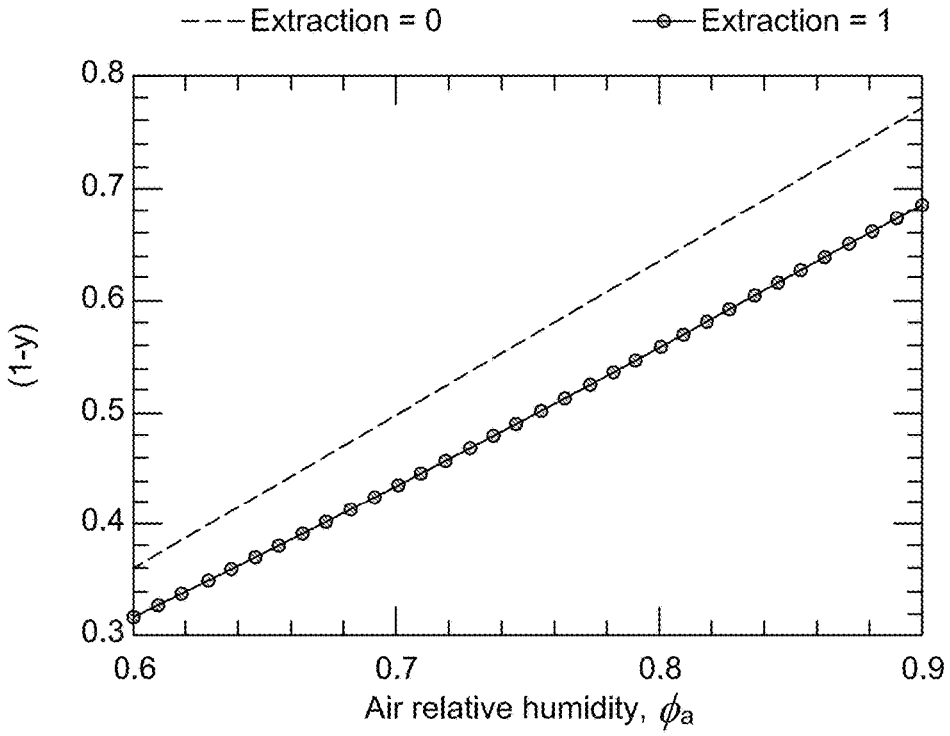

For the same operating conditions of FIG. 13A-13C while considering the typical enthalpy pinch of 20 kJ $kg_a^{-1}$, FIG. 14A shows that the GOR values are 3.3 and 6.6 for zero- and single-extraction systems, respectively against all values of the relative humidity. The system can produce the same amounts of water (60~132.1 $kgh^{-1}$, refer to FIG. 14C) similar to the case of enthalpy pinch is 1 kJ $kg_a^{-1}$ since the low enthalpy pinch values mainly minimize the required heat input (this increases the GOR values) due to the thermodynamic balancing. The desiccant amounts, which hold the water content, are higher for the single-extraction case as shown in FIG. 13(*c*) to achieve the same water product of that in the single-extraction case.

It is important to note that FIGS. 8-14 show the performance of air dryers under typical conditions. However, the maximum limits of air dryers to be run under hot-saturated air ($T_a$=40° C. and $\phi_a$=100%) result in much better system performance by using only six air dryers.

Figure 15A:
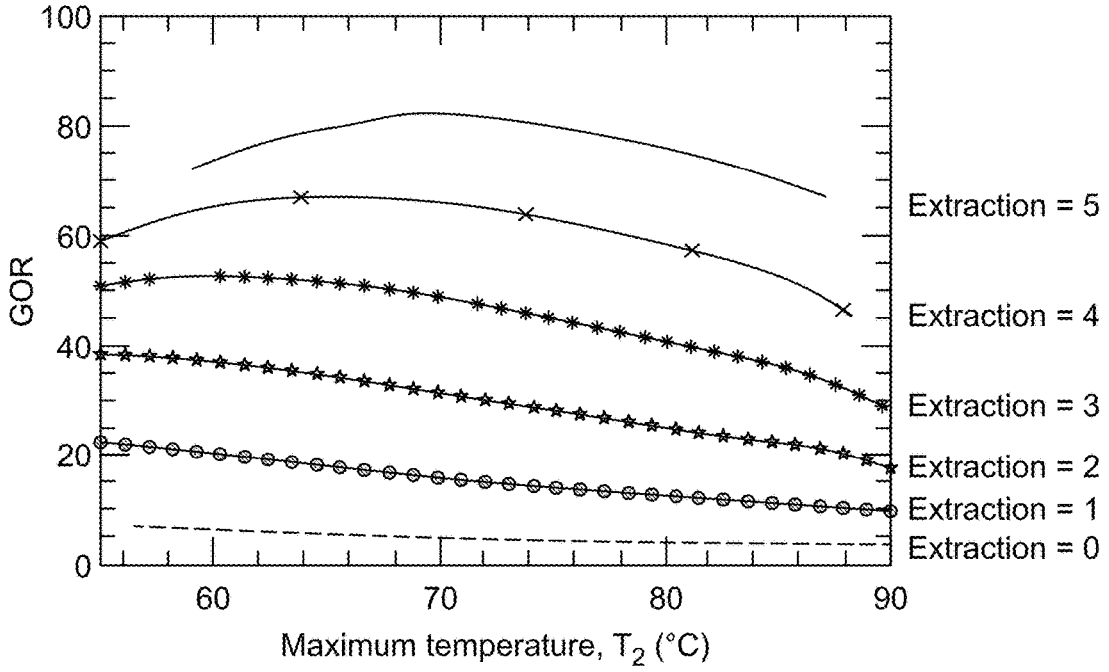
FIG. 15A-15C show the effects of the heated weak desiccant temperature on the system for an enthalpy pinch of 1 $\mu kg_a^{-1}$, where
Figure 15B:
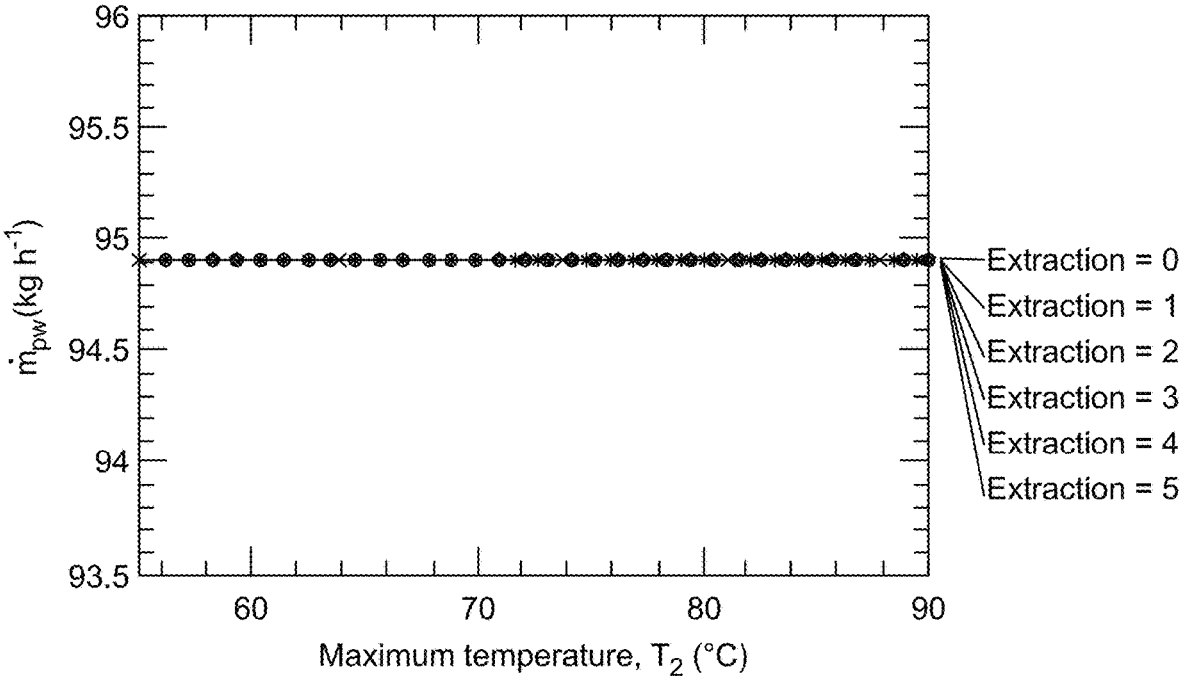
Figure 15C:
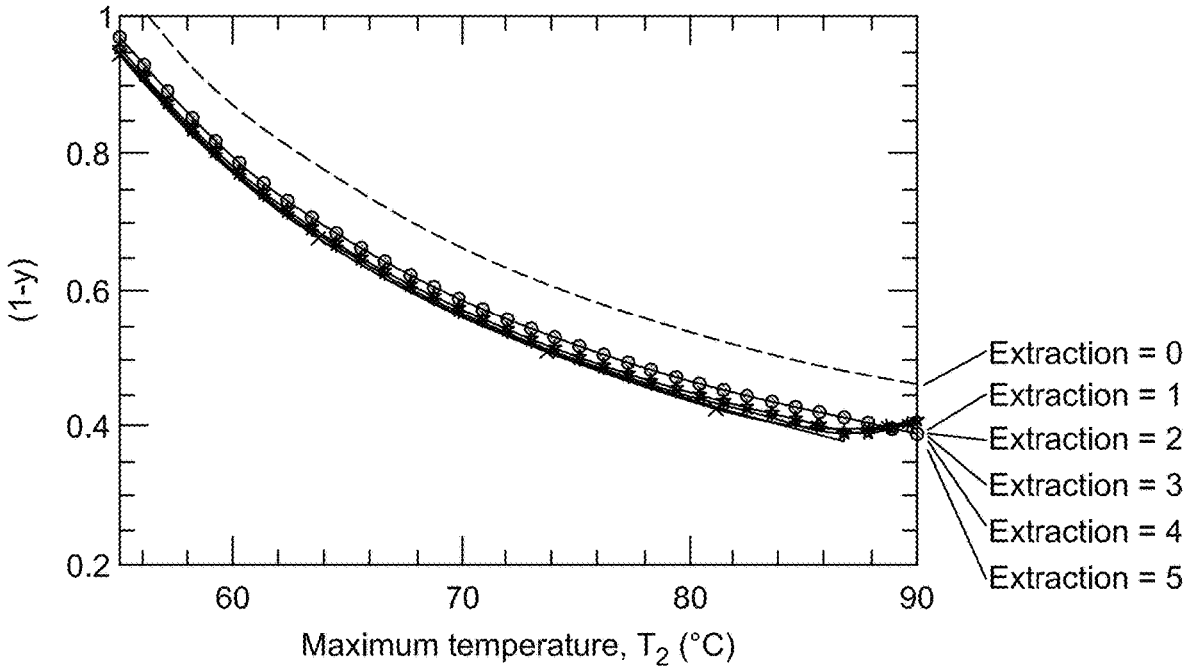

Heating temperature ($T_2$) is a very important parameter that can influence the system performance. Therefore, FIG. 15A-15C and FIG. 16A-16C are devoted to investigate the optimal performance due to the heating temperature between 55 and 90° C. For enthalpy pinch equals 1 kJ $kg_a^{-1}$, FIG. 15A shows that GOR values decrease with increasing the heating temperature for zero-, single-, and double-extraction cases while triple-, quadruple-, and quintuple-extraction have optimal GOR values. These GOR values are 52.7 at 60.7° C. for triple-extraction, 66.9 at 63.8° C. for quadruple-extraction, and 82.9 at 69.8° C. for quintuple-extraction. The water production is constant (94.9 kJ $kg_a^{-1}$) due to that the conditions of the air-dryers are taken the same. With increasing $T_2$ and keeping the same amounts of produced water, desiccant fractions recirculated in the HDH decreases from 1 to almost 0.4 as shown in FIG. 15C. If the same amount of the weak desiccant enters the dehumidifier, the evaporated water content in the humidifier will be higher at high temperature, more than those extracted from air (in the dryers) which results in a stronger desiccant leaving the HDH to enter the dryers; thus, the cyclic operation will be unstable and uncontrolled.

Figure 16A:
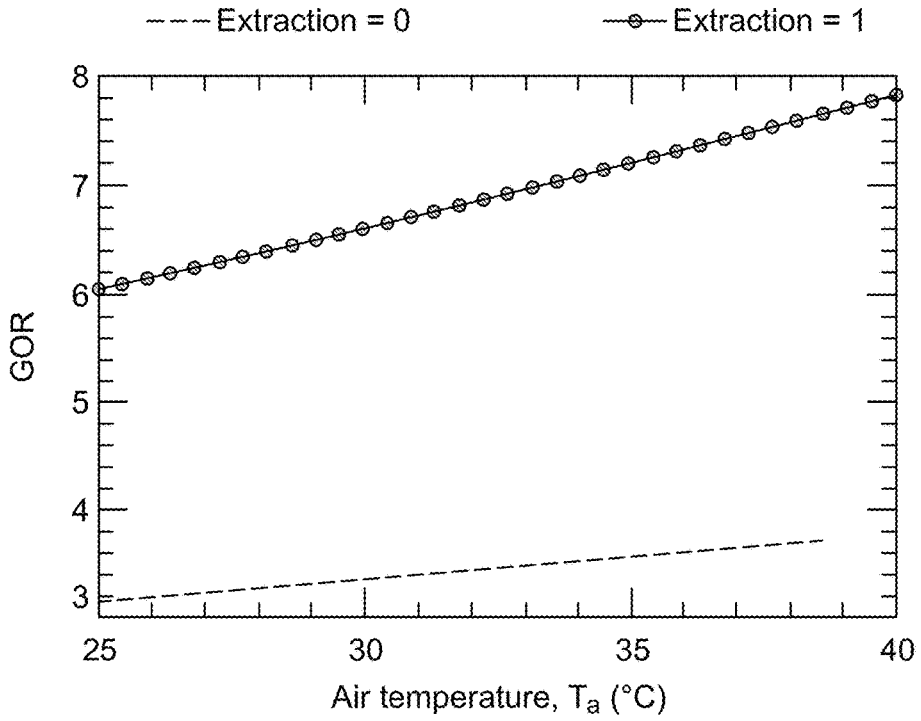
FIG. 16A-16C show the effects of the heated weak desiccant temperature on the system for an enthalpy pinch of 20 $\mu kg_a^{-1}$, where
Figure 16B:
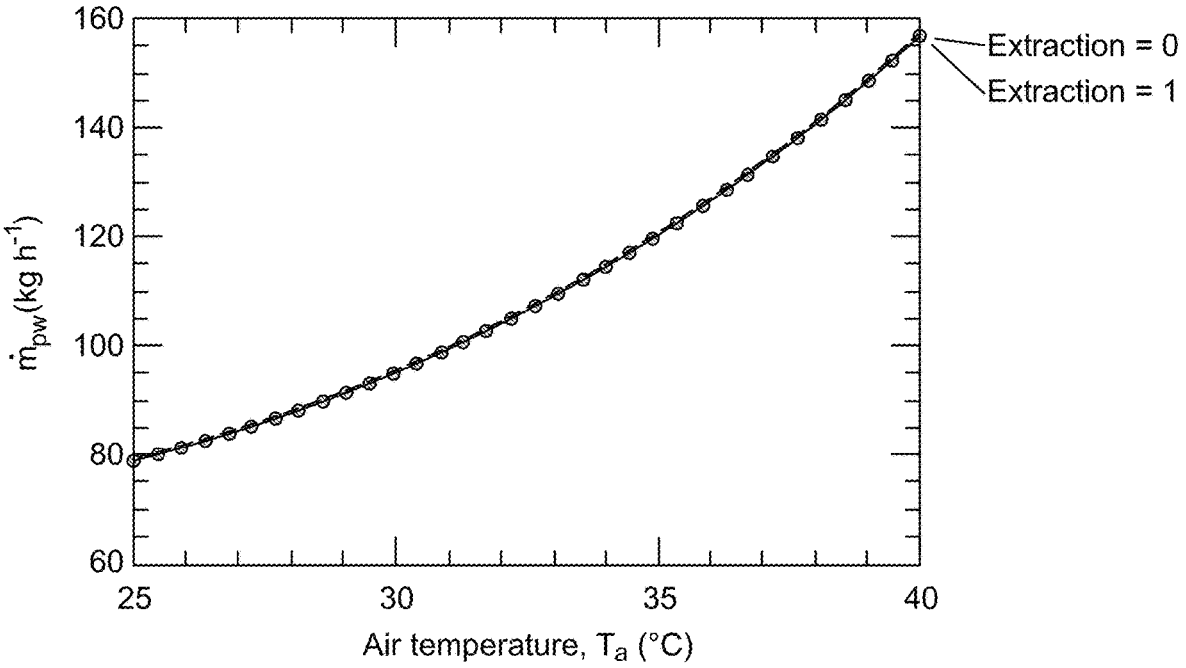
Figure 16C:
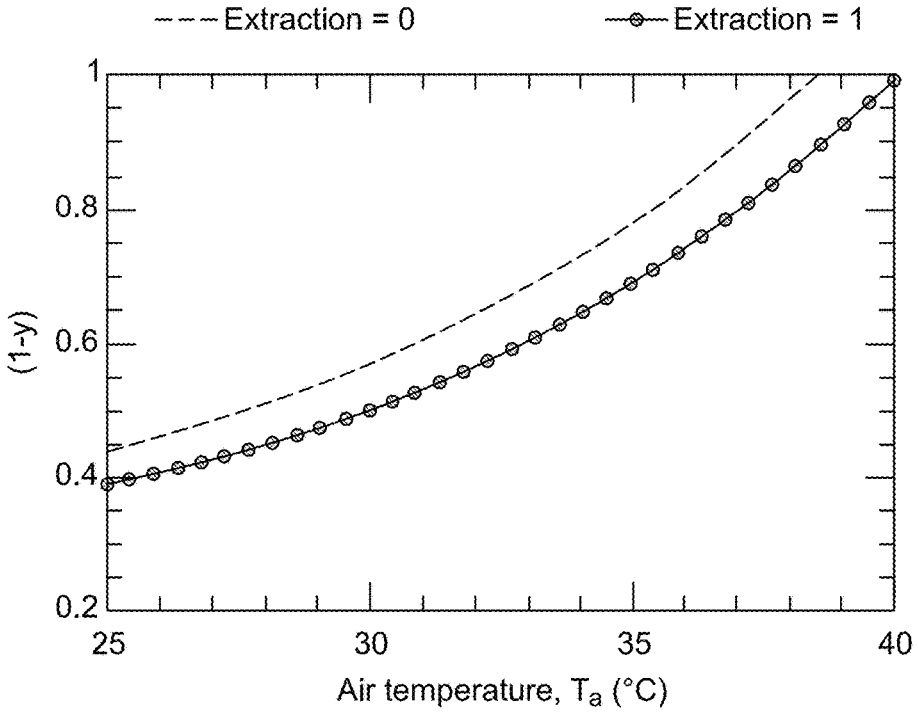

For $\psi$=20 kJ $kg_a^{-1}$, FIG. 16A-16C highlights the effect of the maximum heating temperature on the system performance for only the useful extractions (zero and single). For the zero and single extractions, GOR has optimal values by about 3.4 at 71.4° C. and 6.8 at 87.1° C., respectively, as shown in FIG. 16A. Water production is fixed about 9.45 $kgh^{-1}$ for both systems as shown in FIG. 16B; so that, the weak desiccant fraction decreases as $T_2$ increases, FIG. 16C.

The invention claimed is:

1. A method of extracting freshwater from ambient air comprising:

passing a flow of ambient air over the air dryer system comprising a strong desiccant to produce dry air and a weak desiccant;

heating the weak desiccant to produce a heated desiccant;

cycling a gas mixture, the cycling comprising humidifying a dehumidified gas mixture using a humidifier comprising the heated desiccant to produce a humidified gas mixture and to regenerate the strong desiccant;

dehumidifying the humidified gas mixture using a dehumidifier by cycling the humidified gas mixture from the humidifier to the dehumidifier to produce freshwater and a dehumidified gas mixture;

collecting the freshwater; and returning the strong desiccant to the air dryer system; wherein the cycling of the humidified gas mixture from the humidifier to the dehumidifier and the dehumidified gas mixture from the dehumidifier to the humidifier does not mix the humidified gas mixture with the dehumidified gas mixture and does not mix the humidified gas mixture or the dehumidified gas mixture with ambient air.

2. The method of claim 1, wherein the cycling is performed 2 to 6 times.

3. The method of claim 1, wherein the strong desiccant is an aqueous solution comprising lithium chloride at a concentration of 0.341 to 0.40 kg lithium chloride per kg of aqueous solution and the weak desiccant is an aqueous solution comprising lithium chloride at a concentration of 0.25 to 0.340 kg lithium chloride per kg of aqueous solution.

4. The method of claim 1, which has a freshwater production rate of 40 to 200 $kgh^{-1}$.

5. The method of claim 1, wherein the weak desiccant is heated to 70 to 90° C.

6. The method of claim 1, further comprising cooling the strong desiccant before returning the strong desiccant to the air dryer system.

7. The method of claim 6, wherein the strong desiccant is cooled to a temperature of 20 to 40° C.

8. The method of claim 1, wherein a ratio of a desiccant mass flowrate to an air mass flowrate is adjustable and is of 3.0:1 to 16:1.

9. The method of claim 8, which has an energy consumption of 20 to 250 kWh per $m^3$ of freshwater generated.

10. The method of claim 1, wherein the method has a gained output ratio, defined as the ratio of the product of a mass of freshwater generated by the system times a vaporization latent heat of the freshwater to an amount of heat used to heat the weak desiccant, of 6:1 to 110:1.

* * * * *